US011970935B2

(12) United States Patent
Mustapha

(10) Patent No.: US 11,970,935 B2
(45) Date of Patent: Apr. 30, 2024

(54) TRACER TRACKING FOR CONTROL OF FLOW CONTROL DEVICES ON INJECTION WELLS

(71) Applicant: Schlumberger Technology Corporation, Sugar Land, TX (US)

(72) Inventor: Hussein Mustapha, Abu Dhabi (AE)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 555 days.

(21) Appl. No.: 17/250,072

(22) PCT Filed: May 29, 2019

(86) PCT No.: PCT/US2019/034387

§ 371 (c)(1),
(2) Date: Nov. 18, 2020

(87) PCT Pub. No.: WO2019/232043

PCT Pub. Date: Dec. 5, 2019

(65) Prior Publication Data

US 2021/0207474 A1 Jul. 8, 2021

Related U.S. Application Data

(60) Provisional application No. 62/678,176, filed on May 30, 2018.

(51) Int. Cl.

| | |
|---|---|
| ***E21B 47/11*** | (2012.01) |
| ***E21B 43/12*** | (2006.01) |
| ***E21B 49/08*** | (2006.01) |

(52) U.S. Cl.

CPC ..... *E21B 47/11* (2020.05); *E21B 43/12* (2013.01); *E21B 49/0875* (2020.05); *E21B 2200/20* (2020.05)

(58) Field of Classification Search

CPC ..... E21B 47/11; E21B 43/12; E21B 49/0875; E21B 3300/20; E21B 43/305; E21B 43/117; E21B 49/08; C02F 1/686

See application file for complete search history.

(56) References Cited

U.S. PATENT DOCUMENTS 4,676,313 A * 6/1987 Rinaldi ..... E21B 43/305 166/250.15
5,892,147 A * 4/1999 Garnes ..... E21B 43/117 73/152.14

(Continued)

FOREIGN PATENT DOCUMENTS

WO WO20001065053 * 7/2001

OTHER PUBLICATIONS

International Preliminary Report on Patentability of International Patent Application No. PCT/US2019/034387 dated Dec. 10, 2020, 8 pages.

(Continued)

*Primary Examiner* — Michael J Dalbo
*Assistant Examiner* — Kaleria Knox
(74) *Attorney, Agent, or Firm* — Jeffrey D. Frantz

(57) ABSTRACT

Tracer tracking for control of flow control devices on injection wells includes at least one computer processor executing a reservoir model using numerical tracers to obtain output values for at least one producer well. The numerical tracers are assigned to at least one corresponding injection flow control device in multiple injection flow control devices of an injection well. From the output values at the producer well, a set of volume fraction is calculated for the injection flow control devices. The at least one computer processor solves, using the set of volume frac- (Continued)

tions, an optimization problem to obtain a flow control device parameter, and stores the flow control device parameter in storage.

20 Claims, 14 Drawing Sheets

(56) References Cited

U.S. PATENT DOCUMENTS

| | | | | |
|---|---|---|---|---|
| 2010/0032156 | A1 | 2/2010 | Petty et al. | |
| 2012/0285895 | A1* | 11/2012 | Smiddy | C02F 1/686 210/723 |
| 2015/0013969 | A1 | 1/2015 | Dawson et al. | |
| 2015/0308224 | A1 | 10/2015 | Dyer et al. | |
| 2017/0097443 | A1 | 4/2017 | Bernstein et al. | |
| 2019/0112914 | A1* | 4/2019 | Chen | E21B 43/16 |
| 2019/0203587 | A1* | 7/2019 | Kulyakhtin | E21B 49/08 |

OTHER PUBLICATIONS

International Preliminary Report on Patentability of International Patent Application No. PCT/US2019/034387 dated Dec. 1, 2020, 8 pages.

Robison, C.E. 1997. Overcoming the Challenges Associated With the Life-Cycle Management of Multilateral Wells: Assessing Moves Towards the "Intelligent Completion". Presented at the Offshore Europe, Aberdeen, Sep. 9-12. SPE-38497-MS. http://dx.doi.org/10.2118/38497-MS, 8 pages.

Fernandes et al: Understanding the Roles of Inflow-Control Devices in Optimizing Horizontal-Well Performance, Paper SPE 124677 presented at the SPE Annual Technical Conference, New Orleans, Louisiana, USA, Oct. 4-7, 2009. Peer Reviewed Mar. 2011, 12 pages.

Eltaher et al: Performance of Autonomous Inflow Control Completion in Heavy Oil Reservoirs, Paper IPTC 17977 presented at the International Petroleum Technology Conference, Kuala Lumpur, Malaysia, Dec. 10-12, 2014, 22 pages.

Gavioli et al: Design, Analysis, and Diagnostics for Passive Inflow Control Devices With Openhole Packer Completions, Paper OTC 20348 presented at the Offshore Technology Conference, Houston, Texas, USA, May 3-6, 2010, 20 pages.

Algeroy et al. 1999. Controlling Reservoirs from Afar. Oilfield Review 11 (3): 18-29.

Glandt, C.A. 2005. Reservoir Management Employing Smart Wells: A Review. SPE Drill & Compl 20 (4): 281-288. SPE-81107-PA. http:// dx.doi.org/10.2118/81107-PA.

Brouwer, D.R. and Jansen, J.D. 2004. Dynamic Optmization of Water Flooding With Smart Wells Using Optimal Control Theory. SPE J. 9 (4): 391-402. SPE-78278-PA. http://dx.doi.org/10.2118/78278-PA.

Addiego-Guevara, E.A., et al., 2008. Insurance Value of Intelligent Well Technology Against Reservoir Uncertainty. Presented at the SPE/DOE Symposium on Improved Oil Recovery, Tulsa, Apr. 20-23. SPE-113918-MS. http://dx.doi.org/10.2118/113918- MS, 16 pages.

Grebenkin ,I.M. and Davies, D.R.: A Novel Optimisation Algorithm for Inflow Control Valve Management, Paper SPE 154472 presented at the EAGE Annual Conference, Copenhagen, Denmark, Jun. 4-7, 2012, 13 pages.

Dilib, F.A., and Jackson, M.D.: Closed-Loop Feedback Control for Production Optimization of Intelligent Wells Under Uncertainty, Paper SPE 150096 accepted for presentation at the SPE Intelligent Energy International, Jaarbeursm Utrecht, the Netherlands, Mar. 27-29, 2012, 19 pages.

Aitokhuehi, I. and Durlofsky, L.J. 2005. Optimizing the performance of smart wells in complex reservoirs using continuously updated geologi-cal models. J. Pet. Sci. Eng. 48 (3-4): 254-264. http://dx.doi.org/ 10.1016/j.petrol.2005.06.004.

Brouwer et al. 2001. Recovery Increase through Water Flooding with Smart Well Technology. Presented at the SPE European Formation Damage Conference, The Hague, May 21-22. SPE-68979-MS. http:/dx.doi.org/10.2118/68979-MS, 10 pages.

Brouwer et al. 2004. Improved Reservoir Management Through Optimal Control and Continuous Model Updat-ing. Presented at the SPE Annual Technical Conference and Exhibi- tion, Houston, Sep. 26-29. SPE-90149-MS. http://dx.doi.org/ 10.2118/90149-MS, 11 pages.

Elmsallati, S.M. and Davies, D.R. 2005. Automatic Optimisation of Infi-nite Variable Control Valves. Presented at the International Petroleum Technology Conference, Doha, Qatar, Nov. 21-23. IPTC-10319-MS. http://dx.doi.org/10.2523/10319-MS, 7 pages.

Elmsallati et al. 2005. A Case Study of Value Generation with Intelligent Well Technology in a High Pro-ductivity, Thin Oil Rim Reservoir. Presented at the SPE Middle East Oil and Gas Show and Conference, Kingdom of Bahrain, Mar. 12-15. SPE-94995-MS. http://dx.doi.org/10.2118/94995-MS, 7 pages.

Jansen et al. 2009. Closed Loop Reservoir Management. Presented at the SPE Reservoir Simulation Sympo-sium, The Woodlands, Texas, USA, Feb. 2-4. SPE-119098-MS. http://dx.doi.org/10.2118/119098-MS, 18 pages.

Jansen et al. 2002. Smart Well Solutions for Thin Oil Rims: Inflow Switching and the Smart Stinger Completion. Presented at the SPE Asia Pacific Oil and Gas Conference and Exhibition, Melbourne, Australia, Oct. 8-10. SPE-77942-MS. http://dx.doi.org/10.2118/77942-MS, 10 pages.

Sarma et al. 2005. Implementation of Adjoint Solution for Optimal Control of Smart Wells. Presented at the SPE Reservoir Simulation Symposium, The Woodlands, Texas, USA, Jan. 31-Feb. 2. SPE-92864-MS. http://dx.doi.org/10.2118/92864-MS, 17 pages.

Sarma et al. 2005. Efficient Closed-loop Pro- duction Optimization Under Uncertainty. Presented at the SPE Europec/EAGE Annual Conference, Madrid, Spain, Jun. 13-16. SPE-94241-MS. http://dx.doi.org/10.2118/94241-MS, 14 pages.

Yeten, B. and Jalali, Y. 2001. Effectiveness of Intelligent Completions in a Multiwell Development Context. Presented at the SPE Middle East Oil Show, Bahrain, Mar. 17-20. SPE-68077-MS. http://dx.doi.org/ 10.2118/68077-MS, 7 pages.

Yeten et al. 2004. Decision analysis under uncertainty for smart well deployment. J. Pet. Sci. Eng. 43 (3-4): 183-199. http://dx.doi.org/10.1016/j.petrol.2004.02.013.

Olympus Challenge; ISAPP Integrated Systems Approach for Petroleum Production; http://www.isapp2.com/optimization-challenge.html, accessed on May 1, 2018, 4 pages.

International Search Report dated Sep. 18, 2019 issued in International Application No. PCT/US2019/034387, 3 pages.

Written Opinion of the International Searching Authority dated Sep. 18, 2019 issued in International Application No. PCT/US2019/034387, 7 pages.

* cited by examiner

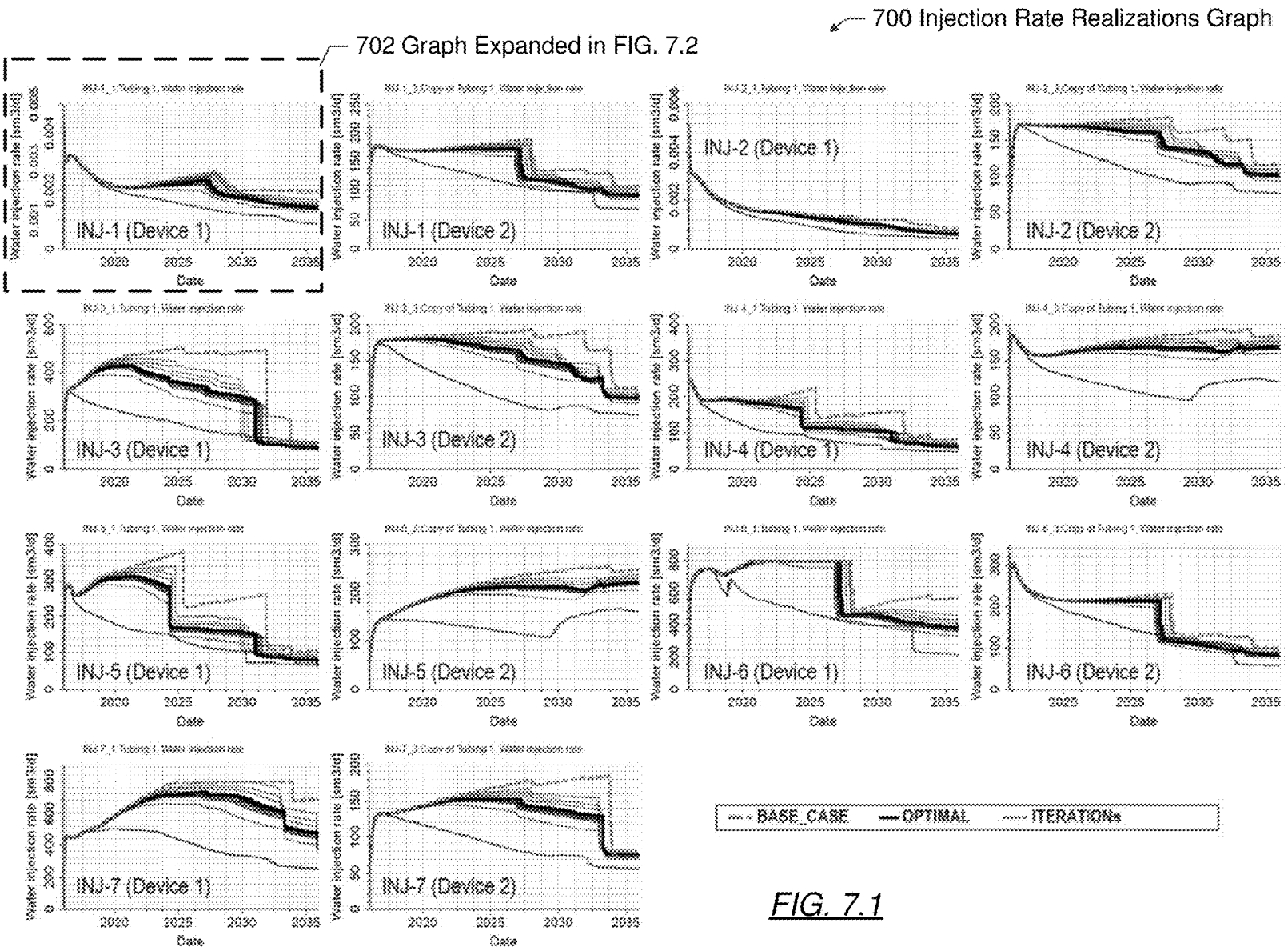
FIG. 7.1

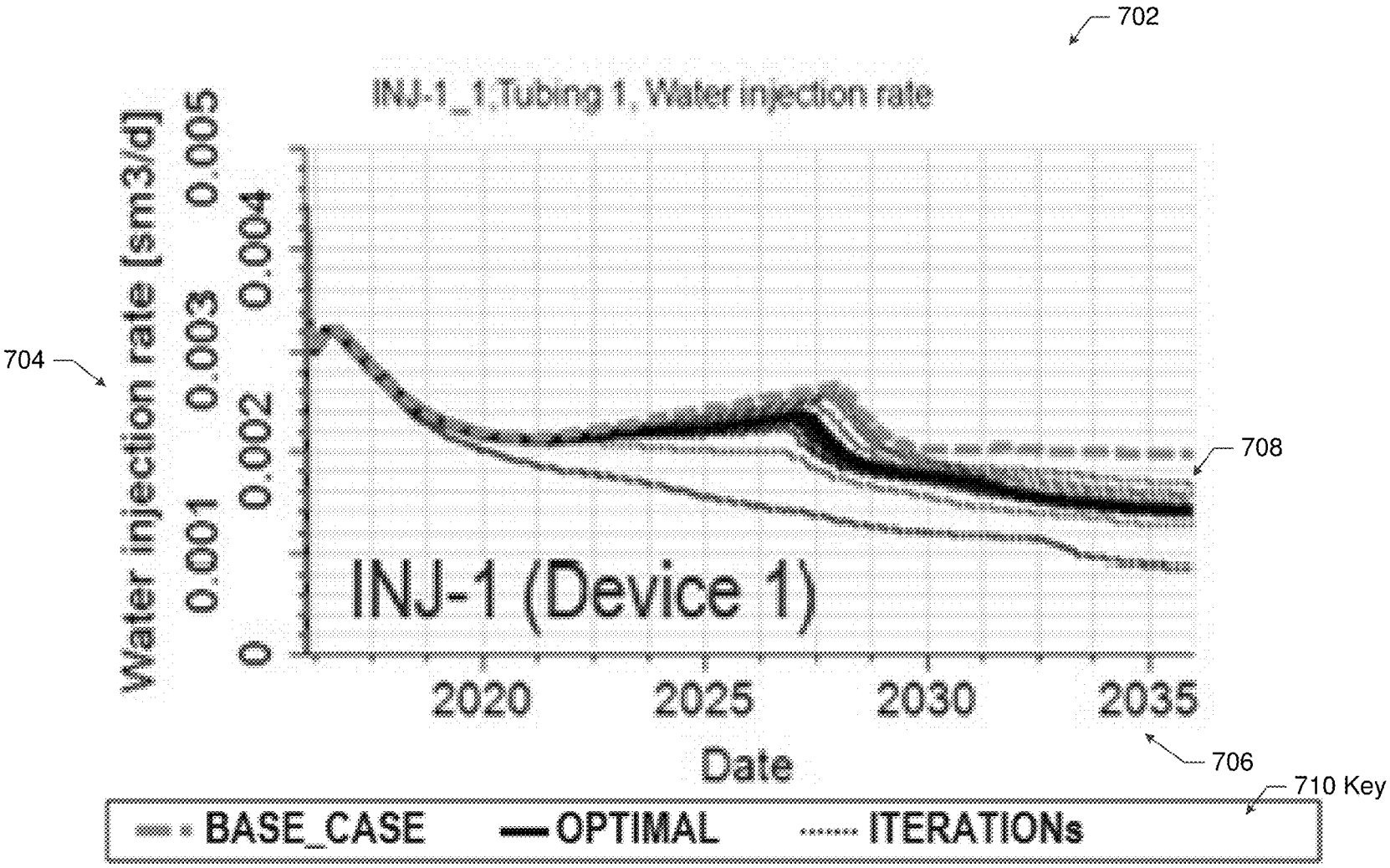
FIG. 7.2

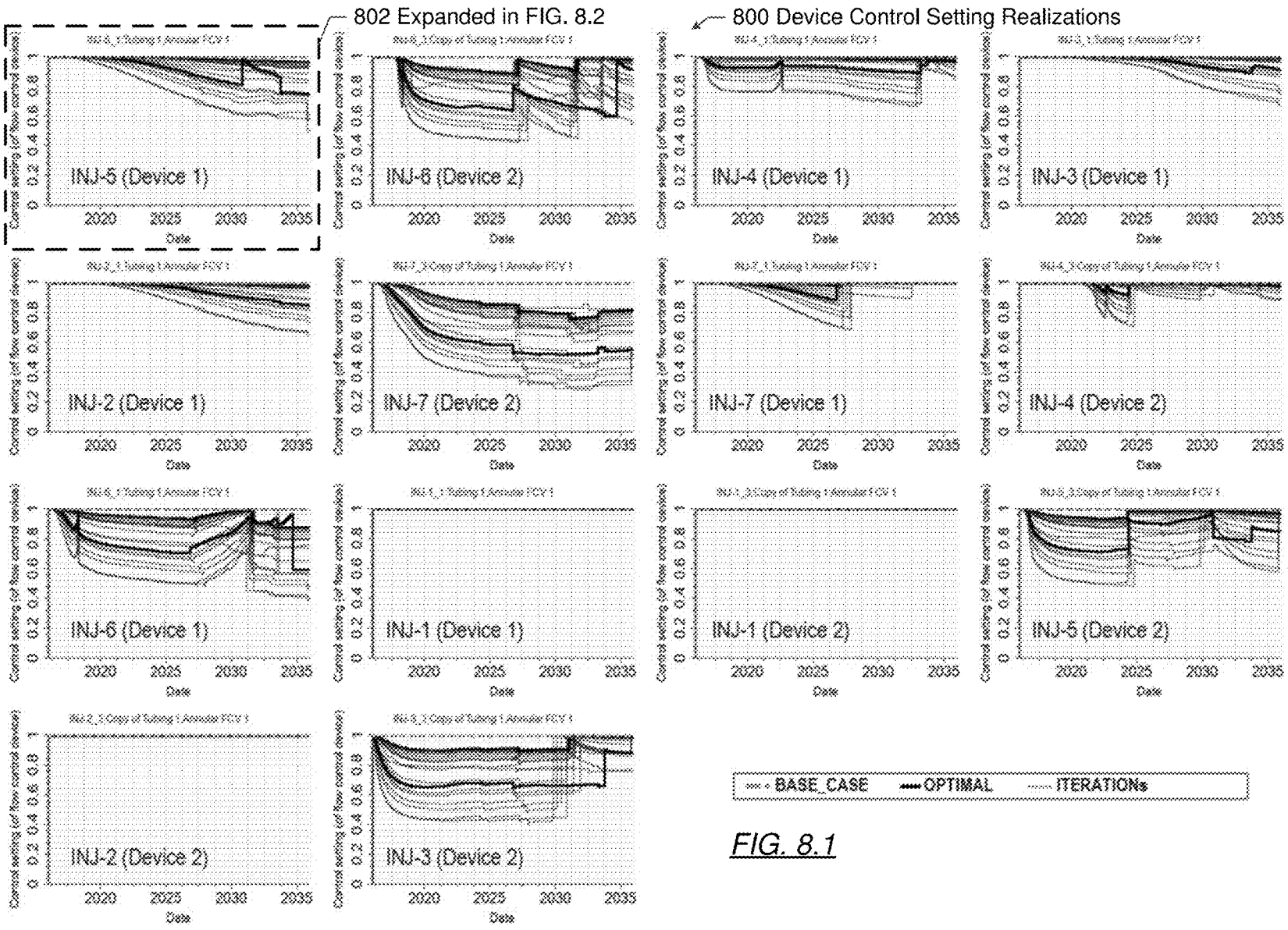
FIG. 8.1

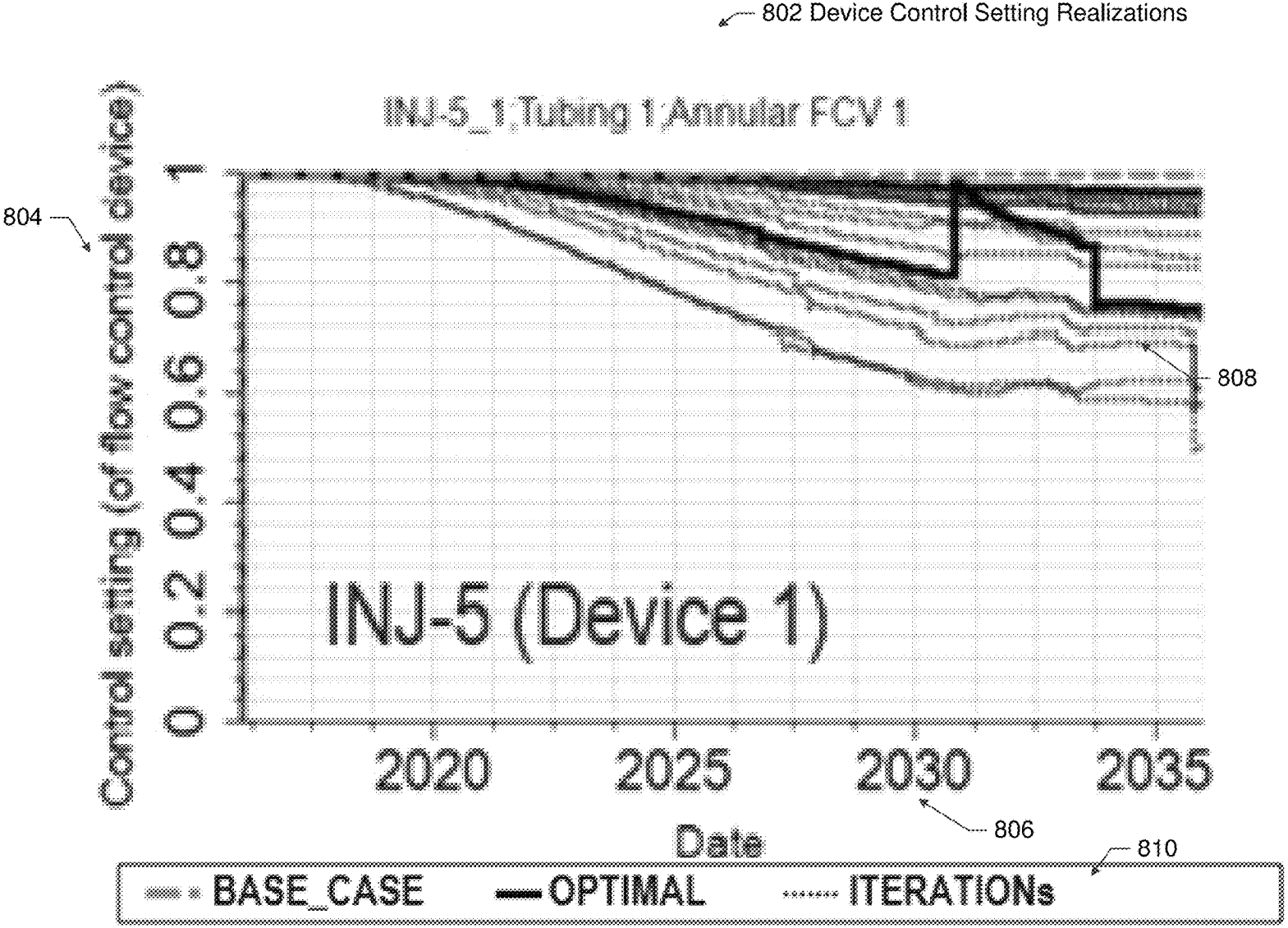
FIG. 8.2

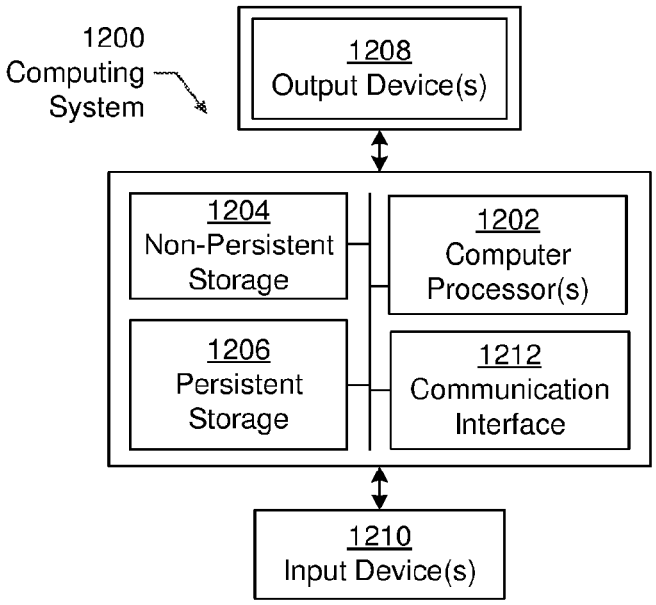
FIG. 12.1
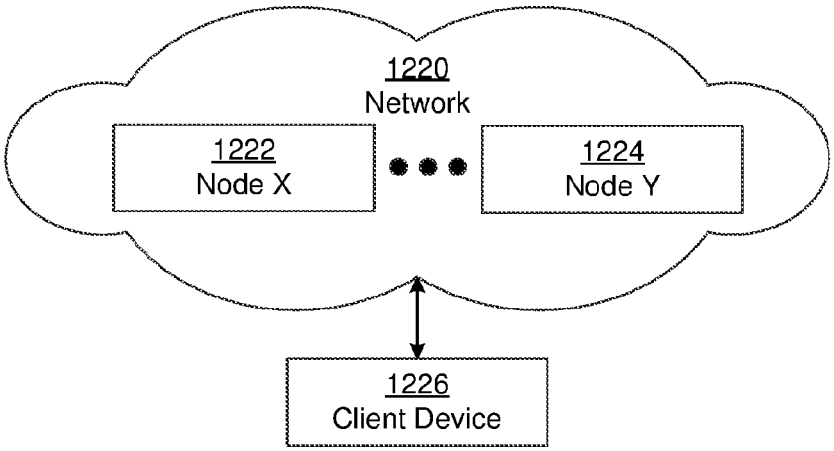
FIG. 12.2

TRACER TRACKING FOR CONTROL OF FLOW CONTROL DEVICES ON INJECTION WELLS

CROSS-REFERENCE TO RELATED APPLICATIONS

This application is the National Stage Entry of International Application No. PCT/US2019/034387, filed May 29, 2019, which claims benefit under 35 U.S.C. § 119 to U.S. Provisional Patent Application Ser. No. 62/678,176, filed on May 30, 2018, entitled, "Improving Oilfield Productivity Based On Tracer Data Mining For Feedback Loop Controls Of Variable Inflow Control Valves" and having the same inventor. U.S. Provisional Patent Application Ser. No. 62/678,176 is incorporated herein by reference in its entirety.

BACKGROUND

During completion operations of a field, injected material, such as water, is injected into injection wells, increasing pressure and causing hydrocarbon production at producer wells. The producer wells and injection wells may be equipped with flow control devices. The flow control devices are mechanical constraints controlling the inflow profile along a well or a branch of well by imposing an additional pressure drop between the sand face and the tubing. Different types of flow control valves exist. One type is a variable flow control device. In a variable flow control device, the valve aperture is variable and can be controlled from the surface.

SUMMARY

One or more embodiments are directed to tracer tracking for control of flow control devices on injection wells. At least one computer processor executes a reservoir model using numerical tracers to obtain output values for at least one producer well. The numerical tracers are assigned to at least one corresponding injection flow control device in multiple injection flow control devices of an injection well. From the output values at the producer well, a set of volume fraction is calculated for the injection flow control devices. The at least one computer processor solves, using the set of volume fractions, an optimization problem to obtain a flow control device parameter, and stores the flow control device parameter in storage.

Other aspects will be apparent from the following description and the appended claims.

BRIEF DESCRIPTION OF DRAWINGS

FIG. 5, FIG. 6, FIG. 7.1, FIG. 7.2, FIG. 8.1, FIG. 8.2.

FIG. 12.1 and FIG. 12.2 shows a computing system in accordance with one or more embodiments.

DETAILED DESCRIPTION

Figure 1:
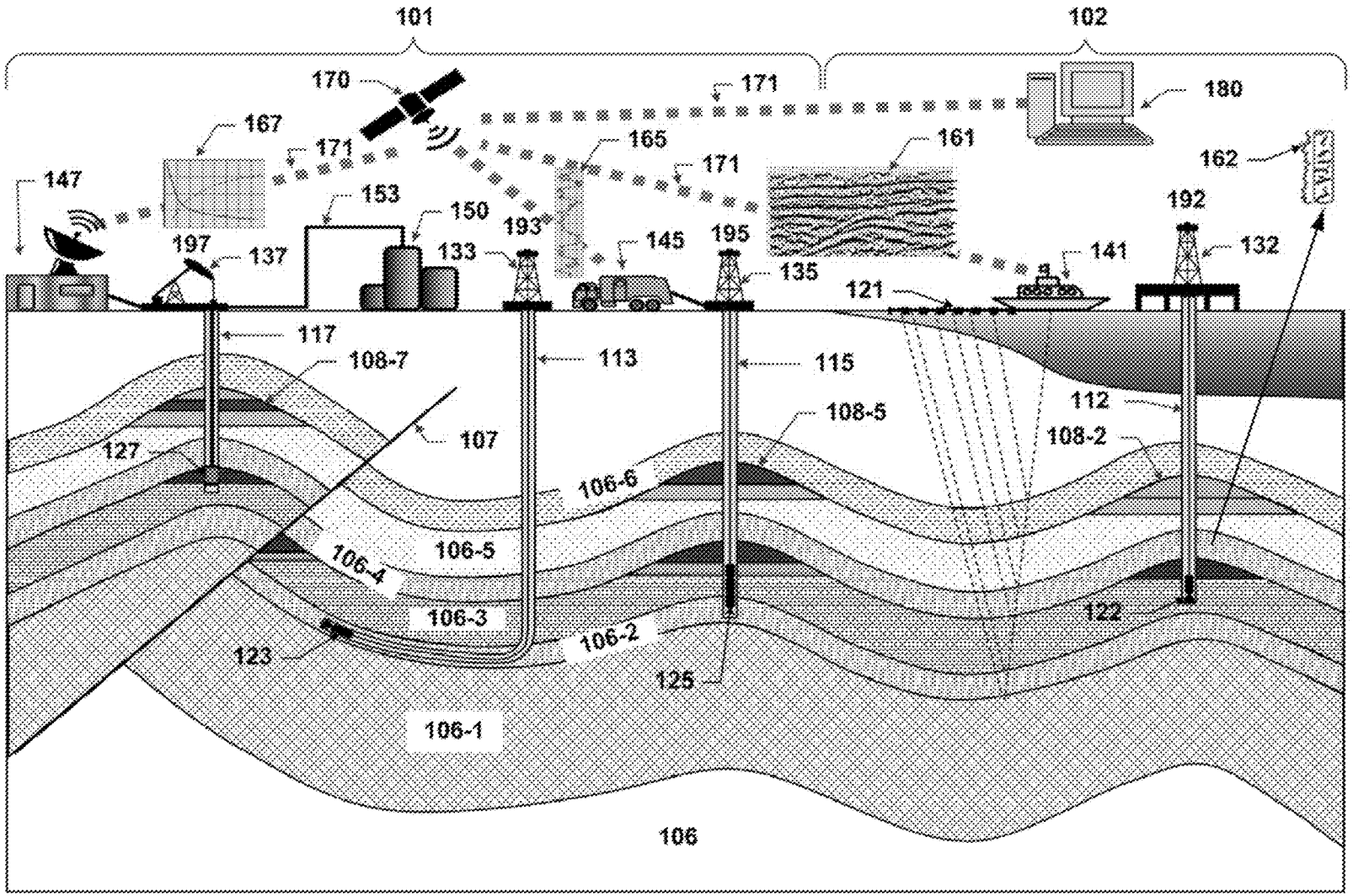
FIG. 1 shows a diagram of an oilfield in accordance with one or more embodiments.

Specific embodiments will now be described in detail with reference to the accompanying figures. Like elements in the various figures are denoted by like reference numerals for consistency.

In the following detailed description of embodiments, numerous specific details are set forth in order to provide a more thorough understanding. However, it will be apparent to one of ordinary skill in the art that embodiments may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments are directed to managing the computer system resources during completion and production operations. During various field operations, injected fluid is injected into an injection well changing the pressures of the subsurface and causing hydrocarbons to be produced from a producer well. The injection well has perforations along the well from which fluid is injected into the subsurface formation. Because the injection well may span multiple geological formations, the injection well may be partitioned into zones using packers. Injection flow control devices along the wellbore of the injection well control the flow of the injected fluid to different zones. Because of the geological subsurface variability, the desired aperture settings of the injection flow control devices may vary between flow control devices and may vary over time. Further, the desired aperture settings may be based on the production of hydrocarbons at the producer well at a current point in time.

During production operations, determining a set of desired aperture settings at an injection well may be complicated because of the variability in the subsurface physical properties, the various flow relationships between the various zones of both the injection well and the producer well. Determining the set of desired aperture settings may be further complicated when multiple injection wells and multiple producer wells exist. Moreover, during production operations, determining the aperture settings by executing a reservoir model through thousands of realizations may be computationally too expensive to be performed on the computer processor. In other words, the computer system may be incapable of simulating the realizations within production operation time constraints.

One or more embodiments are directed to prior generation of a flow control device parameter defining how to adjust the injection flow control device. To generate the flow control device parameter, one or more embodiments relate numeric tracers to injection flow control devices. Reservoir simulations are performed using the numeric tracers to determine the volume fraction of the injection flow control devices. The volume fraction defines the amount of production output that is attributable to the corresponding injection flow control devices. Based on the volume fractions, an optimization problem is solved to obtain a flow control device function parameter. Thus, during production operations, rather than simulating multiple realizations, the flow control device function is used to calculate the aperture settings for injection flow control devices.

Turning to the Figures, FIG. 1 depicts a schematic view, partially in cross section, of an onshore field (101) and an offshore field (102) in which one or more embodiments may be implemented. In one or more embodiments, one or more of the modules and elements shown in FIG. 1 may be omitted, repeated, and/or substituted. Accordingly, embodiments should not be considered limited to the specific arrangement of modules shown in FIG. 1.

As shown in FIG. 1, the fields (101), (102) includes a geologic sedimentary basin (106), wellsite systems (192), (193), (195), (197), wellbores (112), (113), (115), (117), data acquisition tools (121), (123), (125), (127), surface units (141), (145), (147), well rigs (132), (133), (135), production equipment (137), surface storage tanks (150), production pipelines (153), and an exploration and production (E&P) computer system (180) connected to the data acquisition tools (121), (123), (125), (127), through communication links (171) managed by a communication relay (170).

The geologic sedimentary basin (106) contains subterranean formations. As shown in FIG. 1, the subterranean formations may include several geological layers (106-1 through 106-6). As shown, the formation may include a basement layer (106-1), one or more shale layers (106-2, 106-4, 106-6), a limestone layer (106-3), a sandstone layer (106-5), and any other geological layer. A fault plane (107) may extend through the formations. In particular, the geologic sedimentary basin includes rock formations and may include at least one reservoir including fluids, for example the sandstone layer (106-5). In one or more embodiments, the rock formations include at least one seal rock, for example, the shale layer (106-6), which may act as a top seal. In one or more embodiments, the rock formations may include at least one source rock, for example the shale layer (106-4), which may act as a hydrocarbon generation source. The geologic sedimentary basin (106) may further contain hydrocarbon or other fluids accumulations associated with certain features of the subsurface formations. For example, accumulations (108-2), (108-5), and (108-7) associated with structural high areas of the reservoir layer (106-5) and containing gas, oil, water or any combination of these fluids.

In one or more embodiments, data acquisition tools (121), (123), (125), and (127), are positioned at various locations along the field (101) or field (102) for collecting data from the subterranean formations of the geologic sedimentary basin (106), referred to as survey or logging operations. In particular, various data acquisition tools are adapted to measure the formation and detect the physical properties of the rocks, subsurface formations, fluids contained within the rock matrix and the geological structures of the formation. For example, data plots (161), (162), (165), and (167) are depicted along the fields (101) and (102) to demonstrate the data generated by the data acquisition tools. Specifically, the static data plot (161) is a seismic two-way response time. Static data plot (162) is core sample data measured from a core sample of any of subterranean formations (106-1 to 106-6). Static data plot (165) is a logging trace, referred to as a well log. Production decline curve or graph (167) is a dynamic data plot of the fluid flow rate over time. Other data may also be collected, such as historical data, analyst user inputs, economic information, and/or other measurement data and other parameters of interest.

The acquisition of data shown in FIG. 1 may be performed at various stages of planning a well. For example, during early exploration stages, seismic data (161) may be gathered from the surface to identify possible locations of hydrocarbons. The seismic data may be gathered using a seismic source that generates a controlled amount of seismic energy. In other words, the seismic source and corresponding sensors (121) are an example of a data acquisition tool. An example of seismic data acquisition tool is a seismic acquisition vessel (141) that generates and sends seismic waves below the surface of the earth. Sensors (121) and other equipment located at the field may include functionality to detect the resulting raw seismic signal and transmit raw seismic data to a surface unit (141). The resulting raw seismic data may include effects of seismic wave reflecting from the subterranean formations (106-1 to 106-6).

After gathering the seismic data and analyzing the seismic data, additional data acquisition tools may be employed to gather additional data. Data acquisition may be performed at various stages in the process. The data acquisition and corresponding analysis may be used to determine where and how to perform drilling, production, and completion operations to gather downhole hydrocarbons from the field. Generally, survey operations, wellbore operations and production operations are referred to as field operations of the field (101) or (102). These field operations may be performed as directed by the surface units (141), (145), (147). For example, the field operation equipment may be controlled by a field operation control signal that is sent from the surface unit.

Further as shown in FIG. 1, the fields (101) and (102) include one or more wellsite systems (192), (193), (195), and (197). A wellsite system is associated with a rig or a production equipment, a wellbore, and other wellsite equipment configured to perform wellbore operations, such as logging, drilling, fracturing, production, or other applicable operations. For example, the wellsite system (192) is associated with a rig (132), a wellbore (112), and drilling equipment to perform drilling operation (122). In one or more embodiments, a wellsite system may be connected to a production equipment. For example, the well system (197) is connected to the surface storage tank (150) through the fluids transport pipeline (153).

In one or more embodiments, the surface units (141), (145), and (147), are operatively coupled to the data acquisition tools (121), (123), (125), (127), and/or the wellsite systems (192), (193), (195), and (197). In particular, the surface unit is configured to send commands to the data acquisition tools and/or the wellsite systems and to receive data therefrom. In one or more embodiments, the surface units may be located at the wellsite system and/or remote locations. The surface units may be provided with computer facilities (e.g., an E&P computer system) for receiving, storing, processing, and/or analyzing data from the data acquisition tools, the wellsite systems, and/or other parts of the field (101) or (102). The surface unit may also be provided with or have functionally for actuating mechanisms of the wellsite system components. The surface unit may then send command signals to the wellsite system components in response to data received, stored, processed, and/or analyzed, for example, to control and/or optimize various field operations described above.

In one or more embodiments, the surface units (141), (145), and (147) are communicatively coupled to the E&P computer system (180) via the communication links (171). In one or more embodiments, the communication between the surface units and the E&P computer system may be managed through a communication relay (170). For example, a satellite, tower antenna or any other type of communication relay may be used to gather data from multiple surface units and transfer the data to a remote E&P computer system for further analysis. Generally, the E&P computer system is configured to analyze, model, control, optimize, or perform management tasks of the aforementioned field operations based on the data provided from the surface unit. In one or more embodiments, the E&P computer system (180) is provided with functionality for manipulating and analyzing the data, such as analyzing seismic data to determine locations of hydrocarbons in the geologic sedimentary basin (106) or performing simulation, planning, and optimization of exploration and production operations of the wellsite system. In one or more embodiments, the results generated by the E&P computer system may be displayed for user to view the results in a two-dimensional (2D) display, three-dimensional (3D) display, or other suitable displays. Although the surface units are shown as separate from the E&P computer system in FIG. 1, in other examples, the surface unit and the E&P computer system may also be combined. The E&P computer system and/or surface unit may correspond to a computing system, such as the computing system shown in FIGS. 12.1 and 12.2 and described below.

Figure 2:
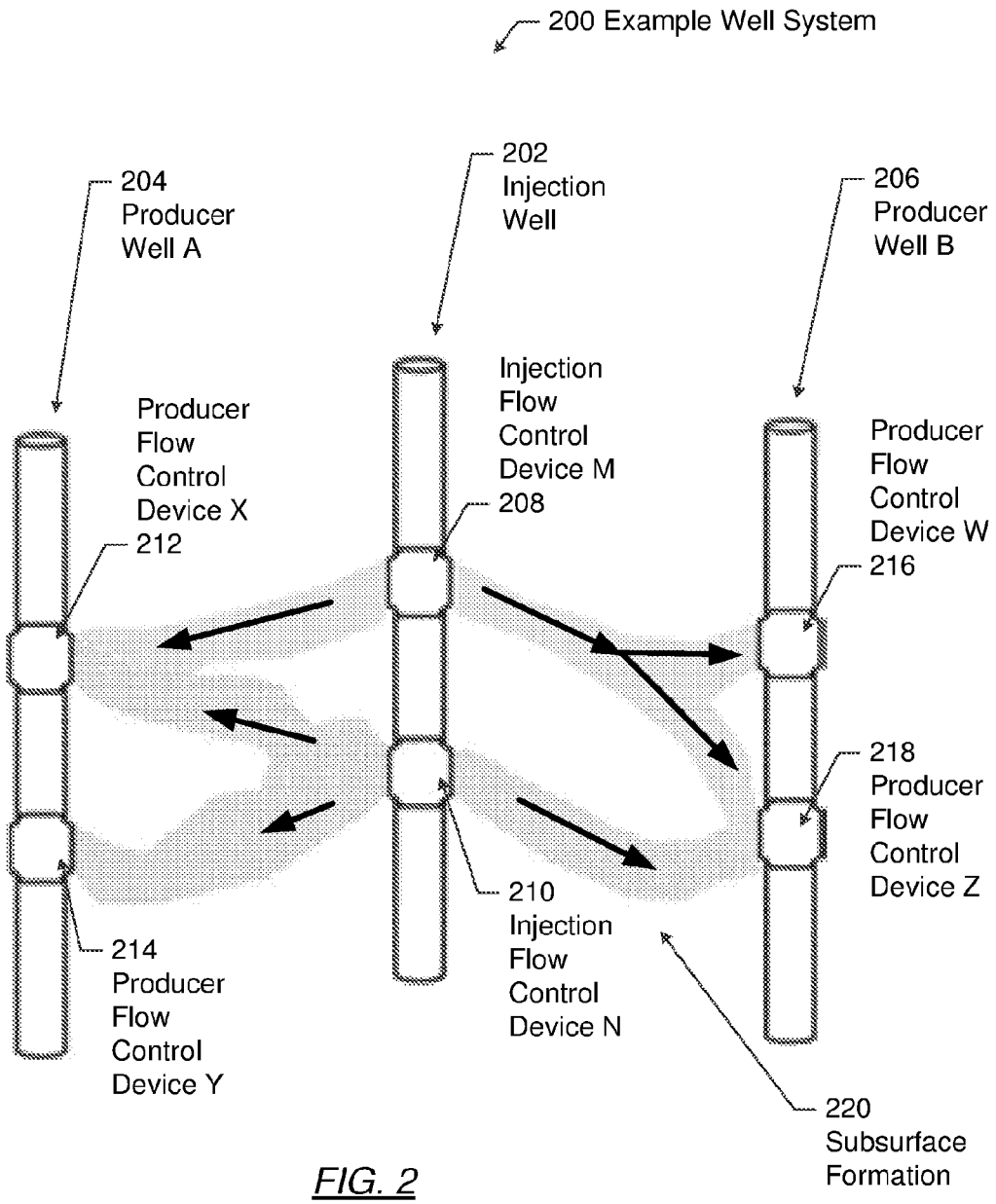
FIG. 2 shows an example diagram of well system in accordance with one or more embodiments.

FIG. 2 shows an example diagram of a well system (200) with fluid flow in accordance with one or more embodiments. In the example shown in FIG. 2, the system (200) includes an injection well (202) and producer wells (e.g., producer well A (204), producer well B (206)) through subsurface formation (220). The schematic diagram of FIG. 2 is for example purposes only and any combination of injection wells and producer wells may exist. The injection well (202) is configured to inject fluid into the subsurface. The injection well (202) includes injection flow control devices (e.g., injection flow control device M (208), injection flow control device N (210)). An injection flow control device is a flow control device that is located at an injection well. The injection flow control devices each control the amount of fluid flow at the respective injection flow control device. For example, the injection flow control device may be a flow control valve. Each injection flow control valve has an aperture setting. The aperture setting defines the size of the aperture, or opening, of the injection flow control device. The aperture setting may define an absolute opening, or a percentage of the total opening. Further, the aperture setting may be defined in terms of the amount of opening or the amount of choke. Each injection flow control device may have a different aperture setting.

As shown in FIG. 2, from each injection flow control device, fluid may flow into the subsurface formation as denoted by the arrows shown in FIG. 2. The fluid flow and resulting pressure changes cause the production of hydrocarbons into the producer well (e.g., producer well A (204), producer well B (206)). In other words, both a portion of the injected fluid and hydrocarbons may flow into the producer wells. The producer well may include producer flow control devices (e.g., producer flow control device X (212), producer flow control device Y (214), producer flow control device W (216), producer flow control device Z (218)). The producer flow control device is a flow control device that is located at the producer well. The producer flow control device control the flow of fluid into the producer well at the respective producer flow control device.

As shown by the arrows in FIG. 2, the flow of fluid from the injection flow control device may not be one for one or direct to producer flow control devices. Specifically, the various rock layers of the subsurface formation (220), such as shown in FIG. 1, as well as the amounts of fluid injected and other parameters may change how fluid flows through the reservoir. One or more embodiments use numerical tracers assigned to injector flow control devices to track fluid flow from the injector flow control device to the producer wells during simulation operations.

Figure 3:
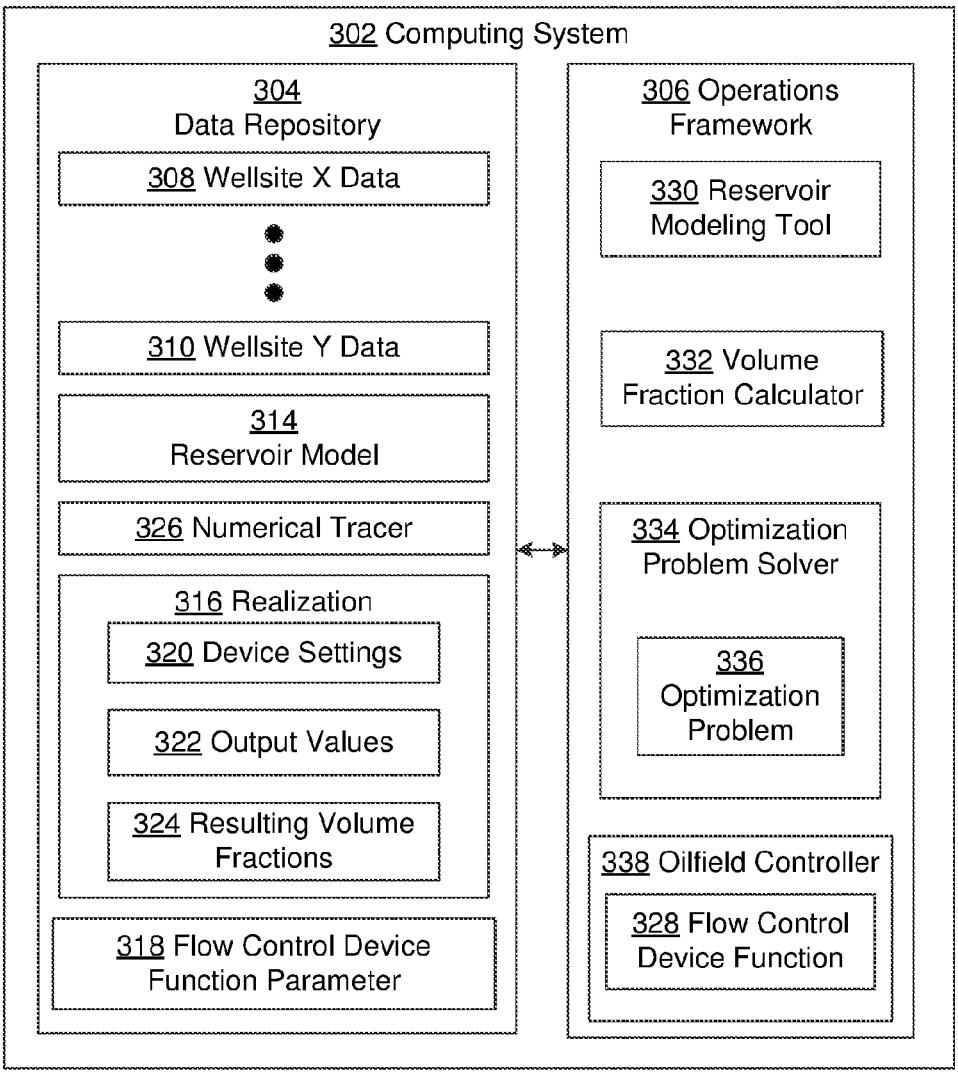
FIG. 3 shows a diagram of a computing system in accordance with one or more embodiments.

Turning to FIG. 3, FIG. 3 is a diagram of a computing system, such as the E&P computing system of FIG. 1. As shown in FIG. 3, the computing system (302) includes an operations framework (306) connected to data repository (304). In one or more embodiments, the data repository (304) is any type of storage unit and/or device (e.g., a file system, database, collection of tables, or any other storage mechanism) for storing data. Further, the data repository (304) may include multiple different storage units and/or devices. The multiple different storage units and/or devices may or may not be of the same type or located at the same physical site.

In one or more embodiments, the data repository (304) includes functionality to store wellsite data (e.g., wellsite X data (308), wellsite Y data (310)). The wellsite data may be any data described above with reference to FIG. 1 and data describing the well, such as the injection wells and producer wells shown in FIG. 1 and FIG. 2. For example, the wellsite data may be static data, dynamically updated data, such as a data stream, or any other data collected from the various equipment at the oilfield. The wellsite data may further include modeled data or data generated using modeling or simulation tools.

The data repository (304) further includes a reservoir model (314), one or more realizations (316), and one or more flow control device function parameters (318). A reservoir model (314) is a model of a reservoir, including the physical properties of the reservoir. In one or more embodiments, the reservoir model (314) is defined as a grid spanning a subsurface region. The grid may be a regular grid or irregular grid. Each location in the grid is a grid cell. The size of the grid cell is the scale at which the reservoir model models the subsurface formations with the reservoir. Each grid cell has physical properties defined for the grid cell. For example, the physical properties may be porosity, permeability, composition, or other properties. The reservoir model may further include information about fluid flow through the reservoir. The physical properties may be obtained from the wellsite data using the oilfield equipment described above with reference to FIG. 1.

A numerical tracer (326) is a tag that is assigned to one or more injection flow control devices in or to trace simulated fluid flow from the injection flow control device to the producer well. For example, a numerical tracer may be a number or an alphanumeric string of characters that are unique as compared to other numerical tracers in the system. The numerical tracer (326) provides a framework for differentiating injection fluid from one injection flow control device to other injection flow control devices. Unique numerical tracers may be assigned to single injection flow control devices or to a group of injection flow control devices. In particular, injection flow control devices may be grouped, where each group is assigned a unique numerical tracer from other groups. For example, grouping may be performed to group injection flow control devices located in the same subsurface zone. A subsurface zone is a region of the subsurface having, within a defined threshold, the same physical properties. For example, to simplify the simulation, injection flow control devices located in the same sedimentary layer may be grouped and the group assigned a single numerical tracer.

A realization (316) is a set of settings for configurable operational parameters (i. e., portions of the field operations that are human adjustable, with or without the use of tools) and the resulting output from the settings. As shown in FIG. 3, the settings include device settings (320). Device settings (320) include the aperture settings for each injection flow control device. The aperture settings may be defined individually for each injection flow control device or individually for each group of two or more injection flow control devices. Grouping may be performed to group injection flow control devices located in the same subsurface zone. A subsurface zone is a region of the subsurface having, within a defined threshold, the same physical properties. For example, to simplify the simulation, injection flow control devices located in the same sedimentary layer may be grouped.

The device settings (320) may further include the volume of injection fluid, composition of the injection fluid, and the rate of injection fluid being injected in the injection well, as well as other settings. The device settings (320) may further include producer well settings, such as the aperture settings of the producer flow control devices.

The realization (316) may also include the output values (322) that are determined from simulations of fluid flow through the reservoir using the reservoir model (314). The output values (322) are defined on a per numerical tracer basis. The output values (322) may further be defined on a per producer well, timespan basis. In other words, each numerical tracer and producer well may have a corresponding set of one or more output values for each timespan in a set of timespans. In another example, the output values may be defined per numerical tracer and for a set of two or more producer wells. The output values may further include a description of the composition of the output, and other properties.

In one or more embodiments, the resulting volume fractions (324) is the portion of the total that is assigned to the particular numerical tracer. For example, for a single producer well, the volume fraction is the output value tagged with the numerical tracer divided by the total output of the single producer well. The total output may include hydrocarbons produced. As another example, the total output may be only the amount of total injected fluid that is then output at the producer well. Because the numerical tracer is assigned to an injection flow control device, or group thereof, and because the resulting volume fraction is for a particular numerical tracer, the resulting volume fraction is for the corresponding injection flow control device or group thereof. For example, if the injected fluid is water, the resulting volume fraction for an injection flow control device is the amount of water from an injection flow control device that is produced at the producer well divided by the total amount of water produced. Each realization (316) may have a unique set of volume fractions.

Continuing with the data repository (304) of FIG. 3, the flow control device function parameter (318) is a parameter of the flow control device function (328) described below. The flow control device function parameter (318) defines the curvature of the flow control device function in accordance with one or more embodiments. The flow control device function parameter (318) may define a different portion of the flow control device function and/or may be a group of parameters of the flow control device function.

Continuing with the computing system (302) of FIG. 3, the operations framework is communicatively connected to the data repository (304). Specifically, the operations framework includes functionality to read, write, and store, directly or indirectly, data in the data repository (304). The operations framework (306) includes a reservoir modeling tool (330). The reservoir modeling tool (330) is a reservoir simulator that includes functionality to simulate the flow of fluids through the subsurface formations and the wellbores. Specifically, the reservoir modeling tool (330) includes functionality to determine the amount of flow, composition, pressure, of fluids through the various rock formations and wellbore using the reservoir model (314). For injected fluid, the reservoir modeling tool (330) includes functionality to assign a unique numerical tracer (326) to each injection flow control device or group thereof and attach the numerical tracer (326) to injected fluid from the injection flow control device or group thereof. The reservoir modeling tool (330) further includes functionality to maintain the numerical tracer with the injected fluid. The reservoir modeling tool may operate through various timesteps, where each timestep represents a period of actual time (e.g., hour, day, week, etc.). For example, the reservoir modeling tool may be configured to predict values representing amount and/or rates of gas, oil, and water flowing to the producer well, and trace the amounts of the injected fluid assigned to the numerical tracer. Other outputs of the reservoir modeling tool may exist and be used.

A volume fraction calculator (332) is a set of instructions configured to calculate the volume fraction for each numerical tracer (326). The volume fraction calculator (332) is further configured to store the volume fraction in the data repository (304) with the corresponding realization.

The optimization problem solver (334) is a solver configured to solve an optimization problem (336) to generate the flow control device function parameters (318). Any of the various different types of optimization problem solvers may be used. The optimization problem solver (334) uses, as input, the realizations and produces, as output, the flow control device function parameter for each injector flow control device, or group thereof. The optimization problem has an objective function and constraints. The objective function may be to maximize production, maximize net present value, minimize water cut, maximize gas oil ratio, or relate to another objective. The constraints may be based on the amount of volume fractions at one or more producer wells. The constraints may further account for the costs associated with recycling injection fluid or performing other production operations. In one or more embodiments, generating a solution for the optimization problem (336) by the optimization problem solver (334) creates the flow control device parameter for a numerical tracer, and correspondingly, for an injection flow control device.

During production operations, an oilfield controller (338) is configured to receive sensor data from the various sensors at the field. Based on the sensor data, the oilfield controller (338) may be configured to directly or indirectly adjust the injector flow control devices according to aperture settings. In one or more embodiments, the aperture settings is defined by the flow control device function (328) that is configured by the flow control device function parameter (318). The flow control device function (328) relates the current water cut to the aperture setting for the injection flow control device. As an individual flow control device function parameter may exist for each individual group of one or more injection control devices, each individual group may have the same or different aperture settings, as compared to other groups, for the same water cut. In other words, when the water cut is X, the flow control device function using the respective flow control device function parameters may define that a first group of injection flow control devices should have aperture setting A while a second group of injection flow control devices have aperture setting B.

While FIG. 1, FIG. 2, and FIG. 3 show a configuration of components, other configurations may be used without departing from the scope presented herein. For example, various components may be combined to create a single component. As another example, the functionality performed by a single component may be performed by two or more components.

Figure 4:
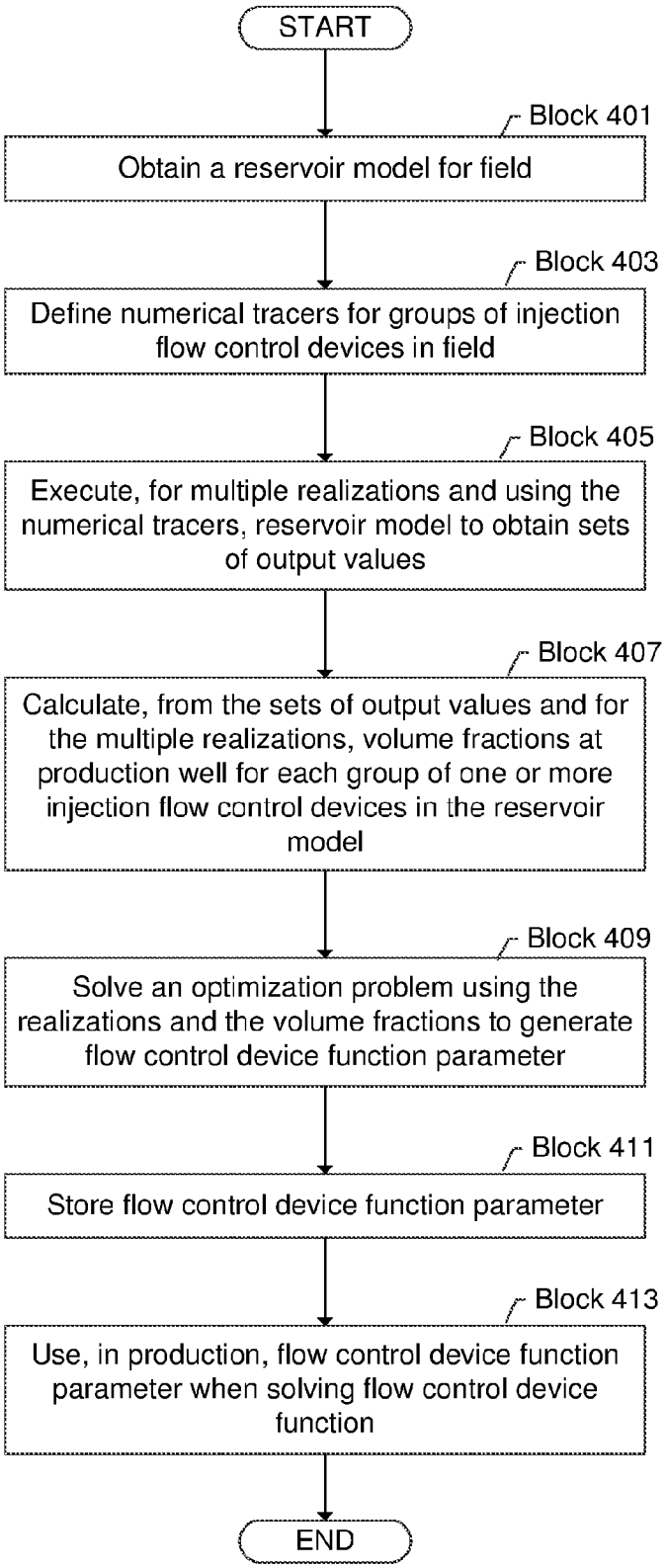
FIG. 4 shows a flowchart in accordance with one or more embodiments.

FIG. 4 shows a flowchart in accordance with one or more embodiments. While the various blocks in this flowchart are presented and described sequentially, one of ordinary skill will appreciate that at least some of the blocks may be executed in different orders, may be combined or omitted, and at least some of the blocks may be executed in parallel. Furthermore, the blocks may be performed actively or passively. For example, some blocks may be performed using polling or be interrupt driven in accordance with one or more embodiments. By way of an example, determination blocks may not require a processor to process an instruction unless an interrupt is received to signify that condition exists in accordance with one or more embodiments. As another example, determination blocks may be performed by performing a test, such as checking a data value to test whether the value is consistent with the tested condition in accordance with one or more embodiments.

In Block 401, a reservoir model for a field is obtained. Various sensor data acquired from the sensors of the field may be used to generate a reservoir model. Interpolation and extrapolation may be performed to estimate any physical property values not directly acquired from sensors.

In Block 403, numerical tracers for groups of the injection flow control devices in the field is defined. A unique numerical tracer is generated, such as by a random number generator, by being a consecutive number, or by being a predefined identifier of a group of one or more injector flow control devices. Groups of one or more injection flow control devices are each assigned to a unique numerical tracer. Thus, each injection flow control device is related to the unique numerical tracer in the reservoir model.

In Block 405, for multiple realizations and using the numerical tracers, the reservoir model is executed to obtain sets of output values. For each of multiple realizations, the following may be performed. The realization defines the set of configurable operational parameters including the size of each aperture of each flow control device, injection fluid type, amount, and rate for each injection well, and other aspects of the injection. The reservoir simulations model the flow of the injection fluid and hydrocarbons through the well and subsurface formations. When injection fluid is modeled as flowing through the injection flow control valve and to the reservoir, the injection fluid is tagged with the numerical tracer of the corresponding injection flow control valve. The simulations model the fluid flow through each timestep. As the tagged injection fluid flows from one grid cell to one or more adjacent grid cells in subsequent timesteps, the amount of the injection fluid flowing to the one or more adjacent grid cells is tagged with the numerical tracer. For example, consider the scenario in which a grid cell has six units of injection fluid that are tagged with the numerical tracer. In the next timestep of the simulation, one unit stays at the same grid cell, three units move to a first adjacent grid cell, and two units move to a second adjacent grid cell. In such a scenario, in that next timestep, the same grid cell has one unit of injection fluid tagged with the numerical tracer, the first adjacent grid cell has three units of injection fluid tagged with the numerical tracer, and the second adjacent grid cell has two units tagged with the numerical tracer. Notably, if injection fluid from different injector flow control devices that are assigned different numerical tracers arrive at the same grid cell, the reservoir modeling tool maintains the amount of the injection fluid on a per numerical tracer basis for the same grid cell. For example, the reservoir modeling tool may maintain, for grid cell M, the amounts of 10 units of injection fluid are assigned numerical tracer Y and 5 units of the injection fluid are assigned numerical tracer Z at timestep t. The process then repeats until the predefined simulation time interval ends. At the producer well, the amounts of injection fluids and corresponding numerical tracers are stored as output values. In other words, for each of multiple simulation timespans (e.g., simulated hour, day, month, year) and for each numerical tracer, the amount of injection fluid tagged with the numerical tracer is stored as an output value for the numerical tracer. The group of amounts for the same realization, whereby each amount corresponds to a distinct numerical tracer, may be referred to as a set of output values. Thus, for multiple realizations, multiple sets of output values may exist.

In Block 407, from the sets of output values and for the multiple realizations, volume fractions at producer well are calculated for each group of one or more injection flow control devices in the reservoir model. For each numerical tracer, the volume fraction is calculated as the amount of the output value for the timespan divided by the sum total for the timespan and the realization.

In Block 409, an optimization problem is solved using the realizations and the volume fractions to generate the flow control device function parameter. In other words, an optimization problem solver solves the optimization problem using the realizations and the volume fractions as input. Solving the optimization problem may include determining a heuristic.

In Block 411, the flow control device function parameter is stored. In particular, the flow control device function parameter is stored in the data repository. In one or more embodiments, the optimization problem and resulting flow control device function parameters are stored for each group of injection flow control devices.

In Block 413, in production, the flow control device function parameter is used when solving the flow control device function. From the current sensor data, the current water cut is determined. Based on the current water cut, the flow control device function is calculated using each corresponding flow control device function parameter to obtain the aperture setting for each group of one or more injector flow control devices. Because a simple calculation is performed at production time, the result is timely and quick. Thus, the computing system is responsive. The output aperture setting may be used directly to change the aperture size of the corresponding injection flow control device. Thus, the field operations may be adjusted.

Figure 5:
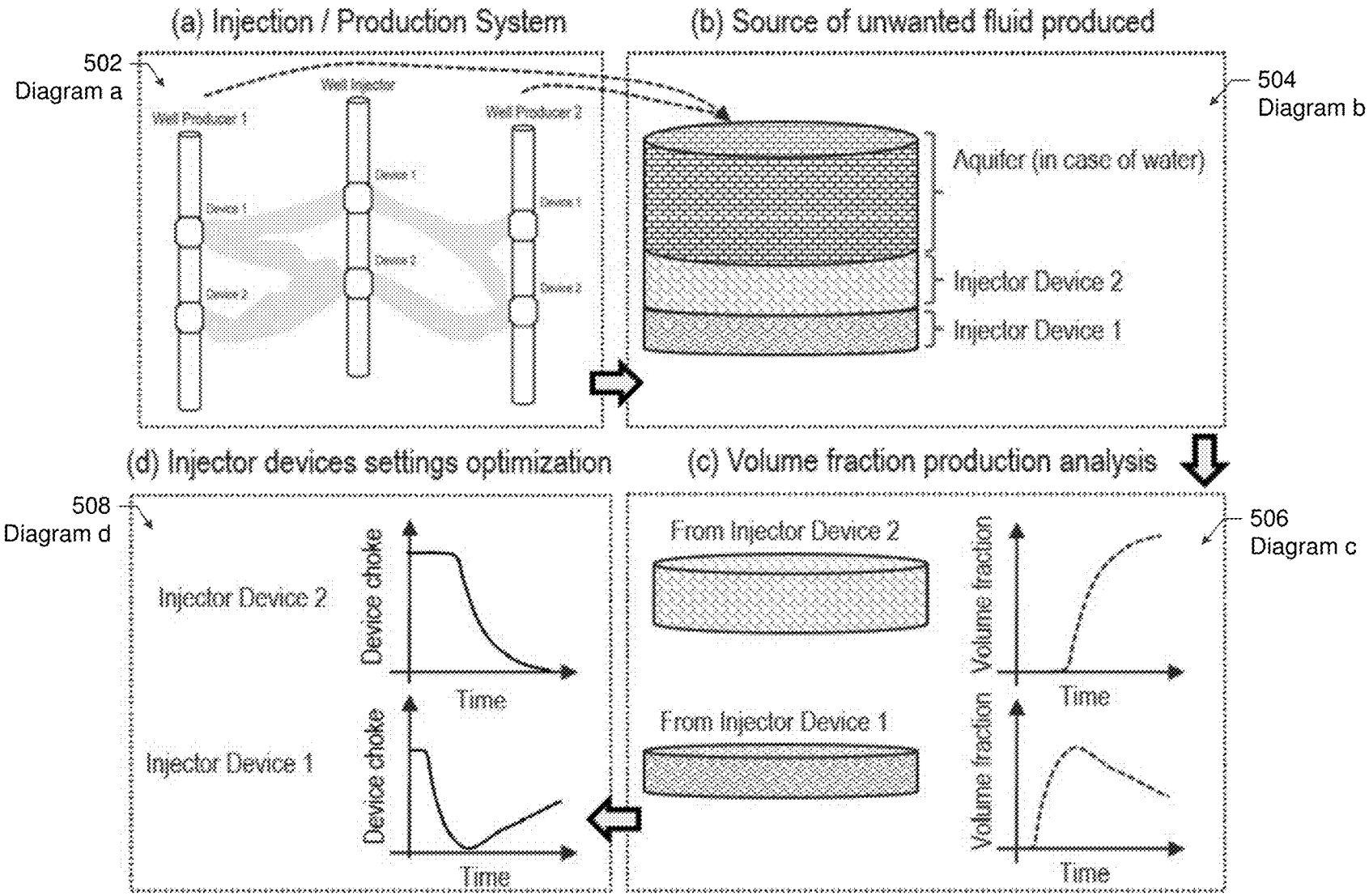
Figure 6:
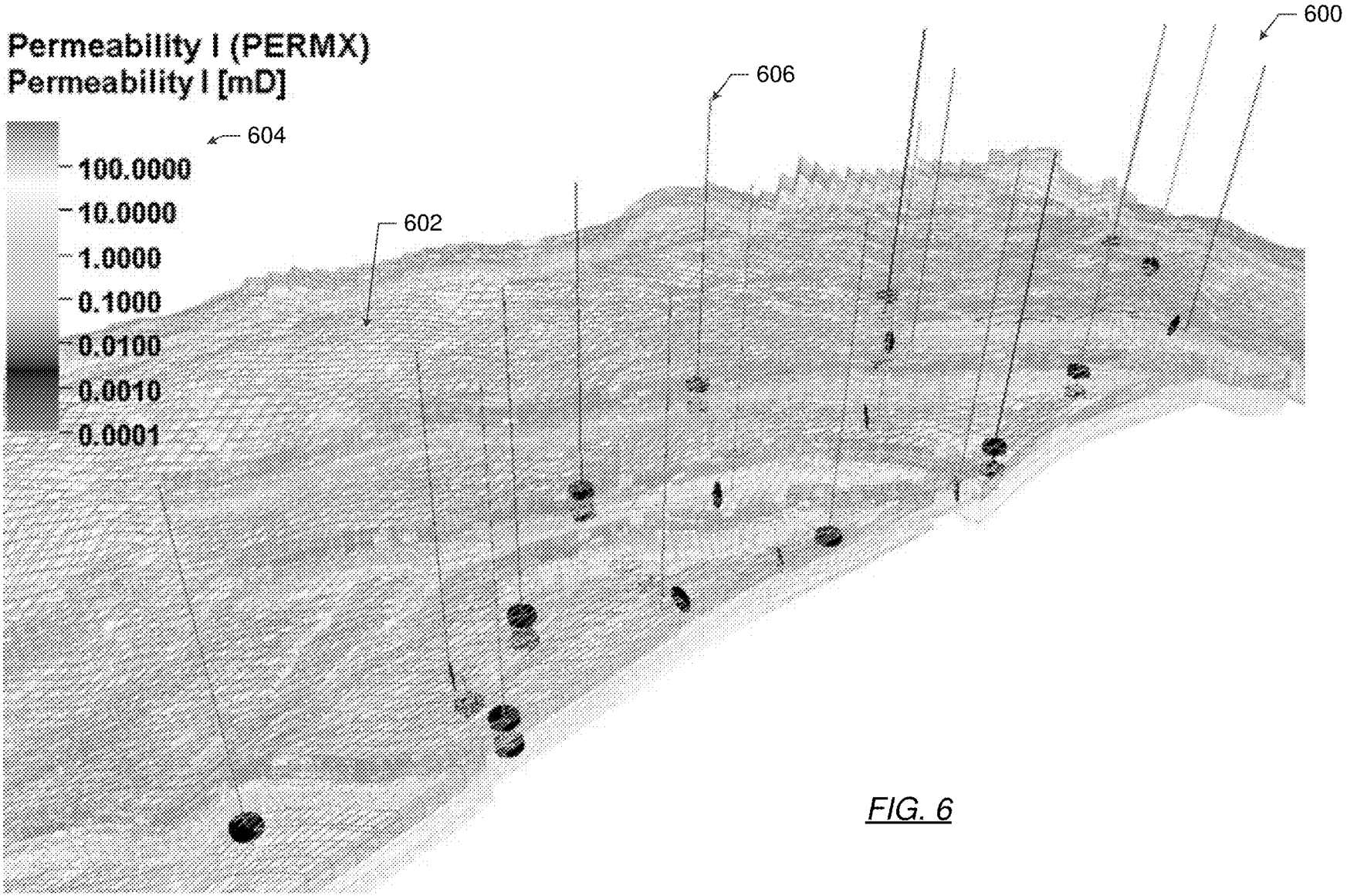
Figure 9:
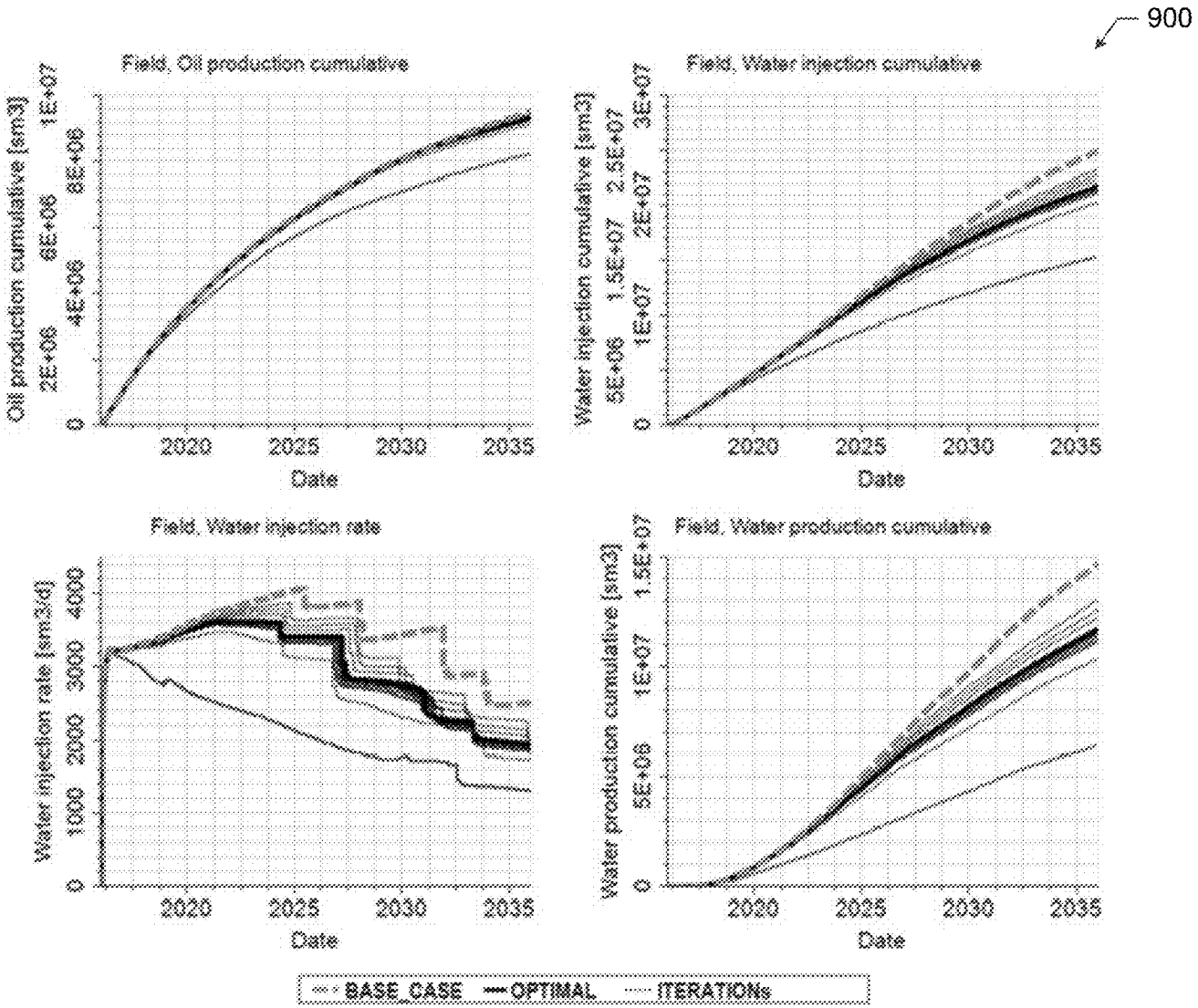
FIG. 9, FIG. 10, and FIG. 11 show examples in accordance with one or more embodiments.
Figure 10:
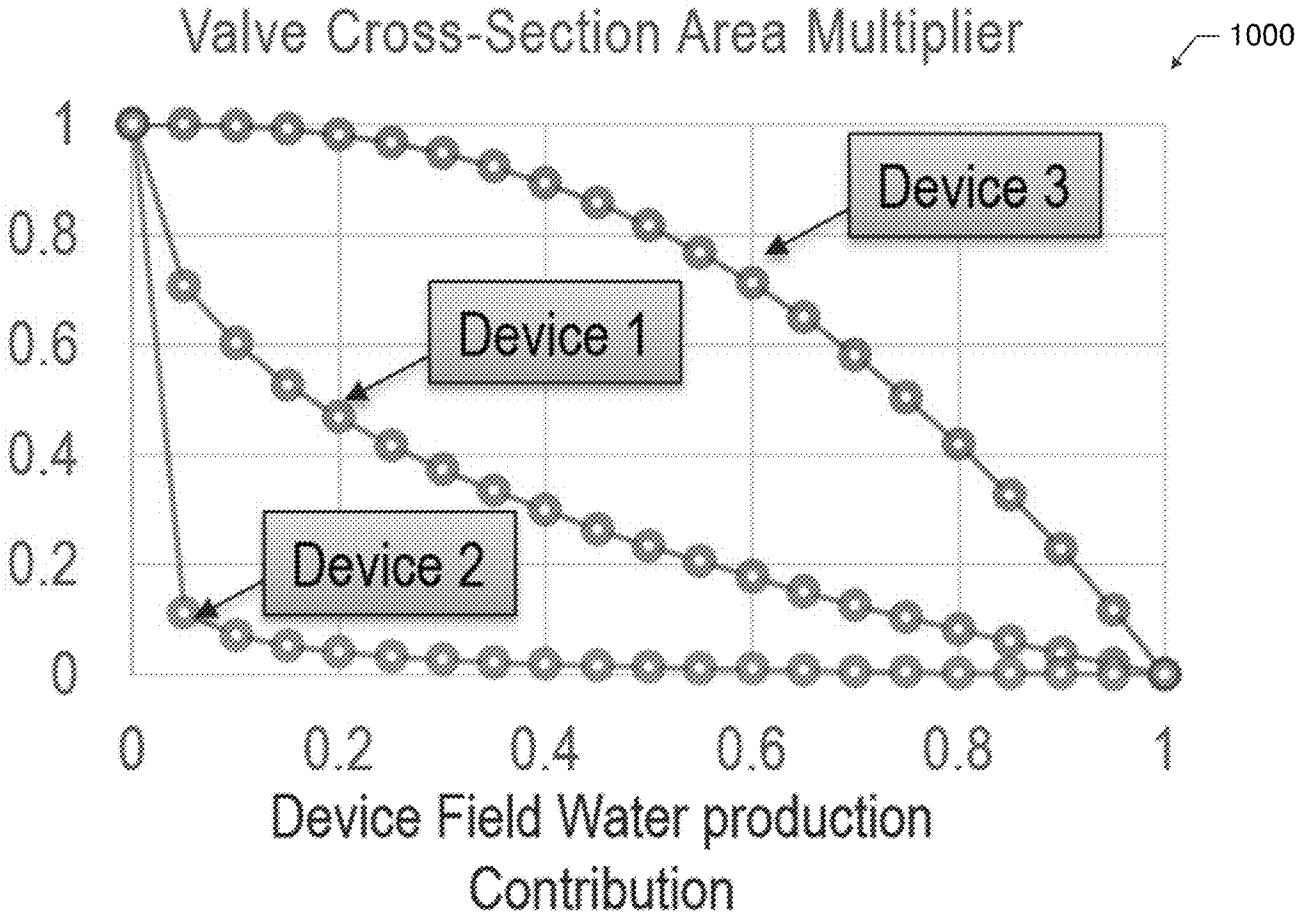
Figure 11:
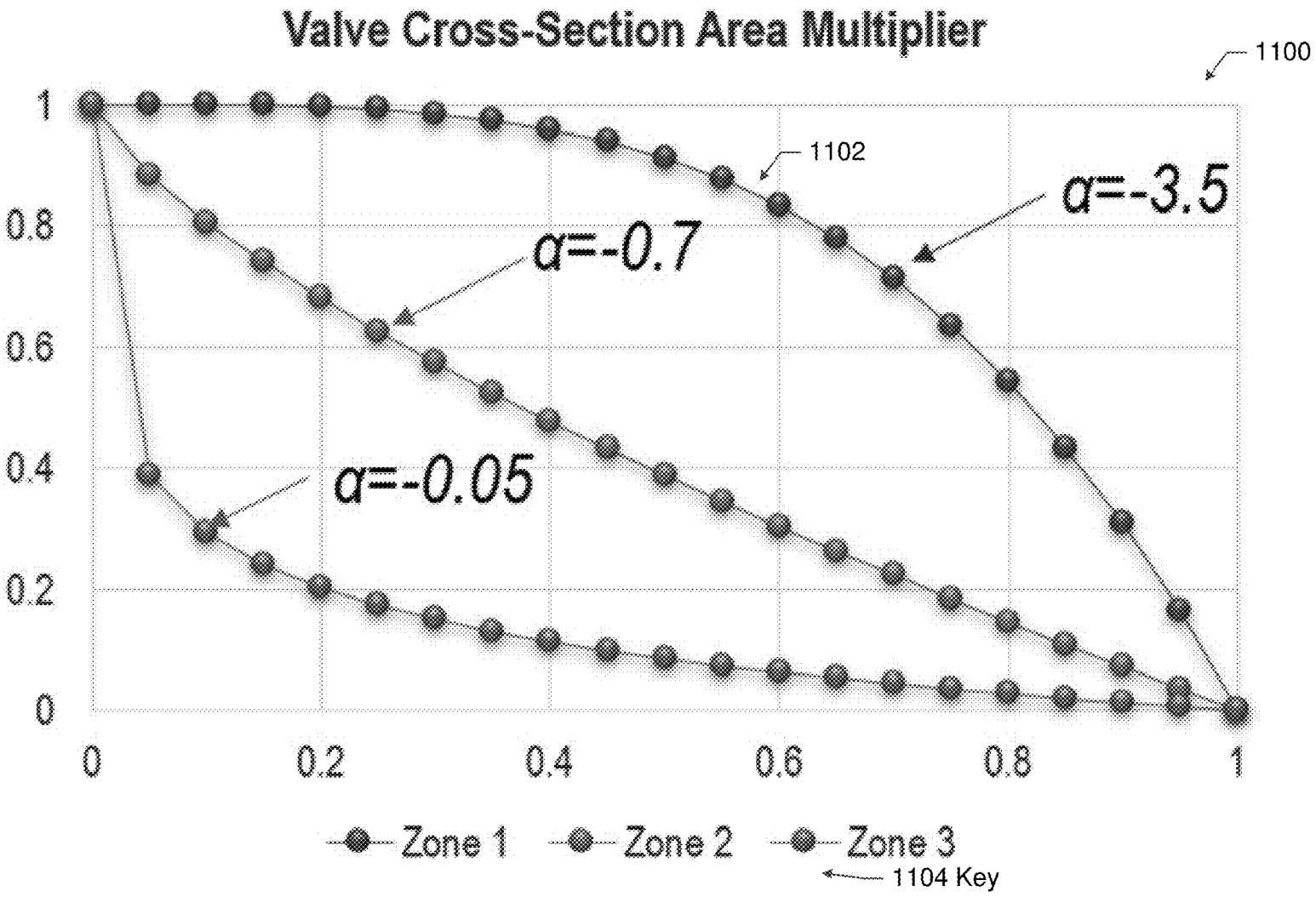

FIG. 5, FIG. 6, FIG. 7.1, FIG. 7.2, FIG. 8.1, FIG. 8.2, FIG. 9, FIG. 10, and FIG. 11 show examples in accordance with one or more embodiments. The following example is for explanatory purposes only and not intended to limit the scope.

Recovery methods such as waterflooding, gas injection or tertiary injection fluids are often used to extend production from primary recovery methods, either by maintaining reservoir pressure or changing the reservoir fluid properties for enhanced oil displacement. A common challenge exists in these recovery methods, namely, to maximize the sweep efficiency of the injection fluids and to predict flow patterns. Heterogeneous and stacked reservoirs may be a particular challenge where complex connectivity between wells may lead to poor operational choices, often resulting in early breakthrough and diminished ultimate recovery.

One or more embodiments optimize the performance of fluid injection schemes using reservoir simulation techniques. An optimization methodology involving the analysis of numerical tracers attached to wells and injector flow control devices. Injected fluids are traced through each injection flow control device of the injectors towards the producer well. The breakthrough of numerical tracer in the simulation, and consequently injected fluid, is measured in each producer well. The data is then implemented as the input for a feedback control on the device to reduce the injection of fluids accordingly. Further, fluid distribution changes over time is analyzed through consideration of the multiple time spans.

The general workflow is presented in FIG. 5 using the example well diagram of FIG. 2. In the case of waterflood, FIG. 5 shows different numerical tracers tracking water injection as shown in diagram a (502). The source of water produced at surface is determined as shown in diagram b (504), and volume fractions over time is calculated as shown in diagram c (506). The volume fraction is expressed as a tracer production concentration using equation (Eq. 2) (discussed below) to choke valves accordingly as shown in diagram d (508). Identification of an ideal choking profile is determined through an optimization process taking the flow control device function parameter $\alpha$ as the main control variable.

FIG. 6 shows an example of a reservoir model (600) through a subsurface formation (602) that is represented as a grayscale grid. As shown by key (604), the grayscale values in the grid represents permeability at the corresponding location. Permeability affects the fluid flow between wells. The vertical lines (e. g., line (606) in FIG. 6 represent wells. For the purposes of the example, consider the scenario in which eleven producer wells exist and seven injection wells exist, whereby the injection wells are intermixed with the producer wells. The cylinders on the wells represent the locations of the flow control devices.

In contrast to a time-consuming and computationally expensive algorithm, a strategy of flow control device adjustment to respond quickly and in real time to operational activities and reservoir conditions changes. A function based optimization is adopted to tune the flow control devices installed in both injection wells and producer wells. The settings of a flow control devices (e.g. valve aperture multiplier) is adjusted based on the Equation Eq. 1.

$$ValveApertureMultiplier_{FlowControlDevice} = \left(\frac{\text{min_WCUT}}{WCUT}\right)^{\alpha} \quad \text{(Eq. 1)}$$

In Equation Eq. 1, WCUT is actual water cut measured at a flow control device, min_WCUT is a minimum threshold, and a is a tuning control parameter. The function that is used is an engineering equation that considers the potential and the phase flow rates of the completion and calculates the cross-section area of the injection/production valve. Eq. 1 has a single variable that is used in the optimization workflow to generate the optimum function for each completion. Identification or classification of heterogeneities can even more reduce the number of variables since flow control devices may be grouped to single variable. In one or more embodiments, the optimization workflow is more stable with large geological uncertainties since the same function (i.e., show in Eq. 1) can be implemented and automated in flow control devices that can be electronically modified, as the function is a closed loop. The form of Eq. 1 allows for direct flow control device settings change a response to water cut profile. The threshold min_WCUT is used to initiate Eq. 1 update when actual WCUT exceeds this threshold. The flow control device will close if WCUT exceeds an upper economic limit.

An optimization algorithm is performed to find an optimum value of a. The optimization algorithm can be coupled with a reservoir simulator in an integrated workflow. The number of times the optimization is called can be predetermined at the beginning based on subdividing the total simulation time into a set of periods.

As the function is defined, various levels of optimization may be performed based on engineering judgments. Initially, a flow control device function parameter can be generated for flow control devices in groups, followed by a separate flow control device function parameter being applied to each of the flow control devices. Realistically, each flow control device should behave differently, especially in a permeability contrast packer strategy. A single flow control device function parameter can be used for the flow control devices in a well, or a separate flow control device function parameter per device. In layered zones, a single flow control device function parameter may be used for the flow control devices in a same zone, or a flow control device function parameter per well device type.

Applying the above concepts to injection devices, Equation Eq. 1 for devices installed in producers having that water cut can be measured accurately with sensors fixed at the devices. As described above with respect to FIG. 5, for injection devices, numerical tracers are used to track the fluid injected from injection flow control devices within the reservoir towards production area and up to the surface. The tracked injection fluid (water or gas) can be expressed at surface as volume fractions. Each fraction expresses the contribution a flow control injection device had on the overall production of an injected fluid. The techniques of Equation Eq. 1 may be applied by considering the tracer production concentration at the place of WCUT. Thus, the flow control device function of Equation Eq. 1 can be written for injection flow control devices using Equation Eq. 2.

$$ValveApertureMultiplier_{InjectorDevice} = \left(\frac{\text{min_TPC}}{TPC}\right) \quad \text{(Eq. 2)}$$

In Equation Eq. 2, TPC refers to the tracer production concentration for a given device, and min_TPC is a minimum limit to trigger the valve adjustment when this limit is exceeded. The flow control device parameter a has physically the same definition as described above with respect to Equation Eq. 1. Generating a may be performed as described above with respect to the workflow shown in FIG. 5.

By way of a more detailed example, consider a well target of 900 sm3/D liquid-production rate with a minimum bottom hole pressure (BHP) limit of 150 bar. In the example, the well is shut in once the water cut, measured at the wellhead, exceeds a maximum threshold limit of 0.88. Water injectors are operating on a target rate of 800 sm3/D and a BHP limit of 235 bar. A limit on liquid production rate is set to 14,000 sm3/D and producers are allocated rate based on a guide rate balancing control. The objective function is to maximize net present value (NPV) by adjusting water injectors' devices. Maximizing NPV by adjusting the water injector's devices means that having the minimum possible water injection and production. For the example, consider the scenario in which the oil price is 70 USD/BOE, produced water operational cost is 6 USD/bbl and water injection cost is 2 USD/bbl.

As part of determining the flow control device parameter, a reservoir model is executed for multiple realizations to obtain a flow control device parameter. The goal is to optimize the shape of the flow control device function in Equation Eq. 2 by sensitizing on parameter α. FIG. 7.1 shows multiple graphs of injection rate realizations (700) executed using the reservoir model. In the multiple graphs, INJ-1, INJ-2, INJ-3, etc. refers to the injection well, and Device 1, Device 2 refers to the flow control device in the injection well. Thus, each graph is for a single injection well flow control device combination. Graph (702) is expanded in FIG. 7.2. Specifically, FIG. 7.2 shows an expanded graph (702) for injection well 1, injection flow control device 1. As shown in FIG. 7.2, for each graph, the vertical axis (704) is the water injection rate and the horizontal axis (706) is time. Each line (708) in the graph corresponds to an individual realization. A single realization has a line in multiple graphs. Key (710) shows the base case and the optimal solution.

FIG. 8.1 shows multiple graphs of device control setting realizations (800). In the multiple graphs, INJ-1, INJ-2, INJ-3, etc. refers to the injection well, and Device 1, Device 2 refers to the flow control device in the injection well. Thus, each graph is for a single injection well flow control device combination. Graph (802) is expanded in FIG. 8.2. Specifically, FIG. 8.2 shows an expanded graph (802) for injection well 5, injection flow control device 1. As shown in FIG. 8.4, for each graph, the vertical axis (804) is the control setting and the horizontal axis (806) is time. Each line (808) in the graph corresponds to an individual realization. A single realization has a line in multiple graphs. Key (810) shows the base case (injection valve is open) and the optimal solution.

A simplex optimizer may be used to find optimal solution. For the purposes of the example, a single flow control device function parameter is determined for the injection flow control devices. More expensive solutions can be carried on by optimizing the settings of valves using a function per well or through a micro-optimization using function per device. The optimal solution has been achieved within 1 hour using a computing system, and after 95 iterations of executing the reservoir model as shown in FIG. 7.1, FIG. 7.2, FIG. 8.1, and FIG. 8.2. The increment in NPV is about 2% by optimizing on injection flow control devices. The field water/oil injector and production profiles are shown in FIG. 9. FIG. 9 shows clearly a significant drop in both water injection and production rates (900). At the injection flow control device level as shown by the solid line in FIG. 7.1 and FIG. 7.2, the water injection rate through each device is dropped. The decrease of injection rates is a response to the reduction in device aperture open for flow as shown by the solid line in FIG. 8.1 and FIG. 8.2.

Nevertheless, the method reinforces the power of variable control with feedback in maximizing the NPV. The optimum value of a can be used to generate a curve that production engineers can use when reacting to zonal water cut during the field life.

As shown in graph (1000) in FIG. 10, depending on heterogeneity in the well, different injector flow control devices may have different flow control device functions based on different flow control device function parameters.

Similarly, as shown in FIG. 11, the same flow control device function parameter may be used for multiple injection flow control devices based on the zones. FIG. 11 shows diverse ways of adjusting flow control devices apertures, as shown by the curves (1102) on the graph (1100), when installed in a heterogenous system with different geological zones. Each curve represents a different zone as shown in Key (1104) The example of FIG. 11, water might follow different paths in a reservoir. In Zone 1, water is flowing slower than in Zone 3. The slower flow justifies the smooth choke of the flow control device in Zone 1 vs a more aggressive choke in Zone 3. Notably, the greater the number of flow control device function parameters, the more computationally expensive solving the problem and getting an optimal solution. Thus, an appropriate analysis of the data available is useful to achieve the targeted results, reasonably faster.

Embodiments may be implemented on a computing system. Any combination of mobile, desktop, server, router, switch, embedded device, or other types of hardware may be used. For example, as shown in FIG. 12.1, the computing system (1200) may include one or more computer processors (1202), non-persistent storage (1204) (e.g., volatile memory, such as random access memory (RAM), cache memory), persistent storage (1206) (e.g., a hard disk, an optical drive such as a compact disk (CD) drive or digital versatile disk (DVD) drive, a flash memory, etc.), a communication interface (1212) (e.g., Bluetooth interface, infrared interface, network interface, optical interface, etc.), and numerous other elements and functionalities.

The computer processor(s) (1202) may be an integrated circuit for processing instructions. For example, the computer processor(s) may be one or more cores or micro-cores of a processor. The computing system (1200) may also include one or more input devices (1210), such as a touchscreen, keyboard, mouse, microphone, touchpad, electronic pen, or any other type of input device.

The communication interface (1212) may include an integrated circuit for connecting the computing system (1200) to a network (not shown) (e.g., a local area network (LAN), a wide area network (WAN) such as the Internet, mobile network, or any other type of network) and/or to another device, such as another computing device.

Further, the computing system (1200) may include one or more output devices (1208), such as a screen (e.g., a liquid crystal display (LCD), a plasma display, touchscreen, cathode ray tube (CRT) monitor, projector, or other display device), a printer, external storage, or any other output device. One or more of the output devices may be the same or different from the input device(s). The input and output device(s) may be locally or remotely connected to the computer processor(s) (1202), non-persistent storage (1204), and persistent storage (1206). Many different types of computing systems exist, and the aforementioned input and output device(s) may take other forms.

Software instructions in the form of computer readable program code to perform embodiments may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that, when executed by a processor(s), is configured to perform one or more embodiments.

The computing system (1200) in FIG. 12.1 may be connected to or be a part of a network. For example, as shown in FIG. 12.2, the network (1220) may include multiple nodes (e.g., node X (1222), node Y (1224)). Each node may correspond to a computing system, such as the computing system shown in FIG. 12.1, or a group of nodes combined may correspond to the computing system shown in FIG. 12.1. By way of an example, embodiments may be implemented on a node of a distributed system that is connected to other nodes. By way of another example, embodiments may be implemented on a distributed computing system having multiple nodes, where each portion may be located on a different node within the distributed computing system. Further, one or more elements of the aforementioned computing system (1200) may be located at a remote location and connected to the other elements over a network.

Although not shown in FIG. 12.2, the node may correspond to a blade in a server chassis that is connected to other nodes via a backplane. By way of another example, the node may correspond to a server in a data center. By way of another example, the node may correspond to a computer processor or micro-core of a computer processor with shared memory and/or resources.

The nodes (e.g., node X (1222), node Y (1224)) in the network (1220) may be configured to provide services for a client device (1226). For example, the nodes may be part of a cloud computing system. The nodes may include functionality to receive requests from the client device (1226) and transmit responses to the client device (1226). The client device (1226) may be a computing system, such as the computing system shown in FIG. 12.1. Further, the client device (1226) may include and/or perform all or a portion of one or more embodiments.

The computing system or group of computing systems described in FIGS. 12.1 and 12.2 may include functionality to perform a variety of operations disclosed herein. For example, the computing system(s) may perform communication between processes on the same or different system. A variety of mechanisms, employing some form of active or passive communication, may facilitate the exchange of data between processes on the same device. Examples representative of these inter-process communications include, but are not limited to, the implementation of a file, a signal, a socket, a message queue, a pipeline, a semaphore, shared memory, message passing, and a memory-mapped file. Further details pertaining to a couple of these non-limiting examples are provided below.

Based on the client-server networking model, sockets may serve as interfaces or communication channel endpoints enabling bidirectional data transfer between processes on the same device. Foremost, following the client-server networking model, a server process (e.g., a process that provides data) may create a first socket object. Next, the server process binds the first socket object, thereby associating the first socket object with a unique name and/or address. After creating and binding the first socket object, the server process then waits and listens for incoming connection requests from one or more client processes (e.g., processes that seek data). At this point, when a client process wishes to obtain data from a server process, the client process starts by creating a second socket object. The client process then proceeds to generate a connection request that includes at least the second socket object and the unique name and/or address associated with the first socket object. The client process then transmits the connection request to the server process. Depending on availability, the server process may accept the connection request, establishing a communication channel with the client process, or the server process, busy in handling other operations, may queue the connection request in a buffer until server process is ready. An established connection informs the client process that communications may commence. In response, the client process may generate a data request specifying the data that the client process wishes to obtain. The data request is subsequently transmitted to the server process. Upon receiving the data request, the server process analyzes the request and gathers the requested data. Finally, the server process then generates a reply including at least the requested data and transmits the reply to the client process. The data may be transferred, more commonly, as datagrams or a stream of characters (e.g., bytes).

Shared memory refers to the allocation of virtual memory space in order to substantiate a mechanism for which data may be communicated and/or accessed by multiple processes. In implementing shared memory, an initializing process first creates a shareable segment in persistent or non-persistent storage. Post creation, the initializing process then mounts the shareable segment, subsequently mapping the shareable segment into the address space associated with the initializing process. Following the mounting, the initializing process proceeds to identify and grant access permission to one or more authorized processes that may also write and read data to and from the shareable segment. Changes made to the data in the shareable segment by one process may immediately affect other processes, which are also linked to the shareable segment. Further, when one of the authorized processes accesses the shareable segment, the shareable segment maps to the address space of that authorized process. Often, only one authorized process may mount the shareable segment, other than the initializing process, at any given time.

Other techniques may be used to share data, such as the various data described in the present application, between processes without departing from the scope. The processes may be part of the same or different application and may execute on the same or different computing system.

Rather than or in addition to sharing data between processes, the computing system performing one or more embodiments may include functionality to receive data from a user. For example, in one or more embodiments, a user may submit data via a graphical user interface (GUI) on the user device. Data may be submitted via the graphical user interface by a user selecting one or more graphical user interface widgets or inserting text and other data into graphical user interface widgets using a touchpad, a keyboard, a mouse, or any other input device. In response to selecting a particular item, information regarding the particular item may be obtained from persistent or non-persistent storage by the computer processor. Upon selection of the item by the user, the contents of the obtained data regarding the particular item may be displayed on the user device in response to the user's selection.

By way of another example, a request to obtain data regarding the particular item may be sent to a server operatively connected to the user device through a network. For example, the user may select a uniform resource locator (URL) link within a web client of the user device, thereby initiating a Hypertext Transfer Protocol (HTTP) or other protocol request being sent to the network host associated with the URL. In response to the request, the server may extract the data regarding the particular selected item and send the data to the device that initiated the request. Once the user device has received the data regarding the particular item, the contents of the received data regarding the particular item may be displayed on the user device in response to the user's selection. Further to the above example, the data received from the server after selecting the URL link may provide a web page in Hyper Text Markup Language (HTML) that may be rendered by the web client and displayed on the user device.

Once data is obtained, such as by using techniques described above or from storage, the computing system, in performing one or more embodiments, may extract one or more data items from the obtained data. For example, the extraction may be performed as follows by the computing system in FIG. 12.1. First, the organizing pattern (e.g., grammar, schema, layout) of the data is determined, which may be based on one or more of the following: position (e.g., bit or column position, Nth token in a data stream, etc.), attribute (where the attribute is associated with one or more values), or a hierarchical/tree structure (consisting of layers of nodes at different levels of detail-such as in nested packet headers or nested document sections). Then, the raw, unprocessed stream of data symbols is parsed, in the context of the organizing pattern, into a stream (or layered structure) of tokens (where each token may have an associated token "type").

Next, extraction criteria are used to extract one or more data items from the token stream or structure, where the extraction criteria are processed according to the organizing pattern to extract one or more tokens (or nodes from a layered structure). For position-based data, the token(s) at the position(s) identified by the extraction criteria are extracted. For attribute/value-based data, the token(s) and/or node(s) associated with the attribute(s) satisfying the extraction criteria are extracted. For hierarchical/layered data, the token(s) associated with the node(s) matching the extraction criteria are extracted. The extraction criteria may be as simple as an identifier string or may be a query presented to a structured data repository (where the data repository may be organized according to a database schema or data format, such as XML).

The extracted data may be used for further processing by the computing system. For example, the computing system of FIG. 12.1, while performing one or more embodiments, may perform data comparison. Data comparison may be used to compare two or more data values (e.g., A, B). For example, one or more embodiments may determine whether A>B, A=B, A l=B, A<B, etc. The comparison may be performed by submitting A, B, and an opcode specifying an operation related to the comparison into an arithmetic logic unit (ALU) (i. e., circuitry that performs arithmetic and/or bitwise logical operations on the two data values). The ALU outputs the numerical result of the operation and/or one or more status flags related to the numerical result. For example, the status flags may indicate whether the numerical result is a positive number, a negative number, zero, etc. By selecting the proper opcode and then reading the numerical results and/or status flags, the comparison may be executed. For example, in order to determine if A>B, B may be subtracted from A (i.e., A−B), and the status flags may be read to determine if the result is positive (i.e., if A>B, then A−B>0). In one or more embodiments, B may be considered a threshold, and A is deemed to satisfy the threshold if A=B or if A>B, as determined using the ALU. In one or more embodiments, A and B may be vectors, and comparing A with B requires comparing the first element of vector A with the first element of vector B, the second element of vector A with the second element of vector B, etc. In one or more embodiments, if A and B are strings, the binary values of the strings may be compared.

The computing system in FIG. 12.1 may implement and/or be connected to a data repository. For example, one type of data repository is a database. A database is a collection of information configured for ease of data retrieval, modification, re-organization, and deletion. Database Management System (DBMS) is a software application that provides an interface for users to define, create, query, update, or administer databases.

The user, or software application, may submit a statement or query into the DBMS. Then the DBMS interprets the statement. The statement may be a select statement to request information, update statement, create statement, delete statement, etc. Moreover, the statement may include parameters that specify data, or data container (database, table, record, column, view, etc.), identifier(s), conditions (comparison operators), functions (e.g. join, full join, count, average, etc.), sort (e.g. ascending, descending), or others. The DBMS may execute the statement. For example, the DBMS may access a memory buffer, a reference or index a file for read, write, deletion, or any combination thereof, for responding to the statement. The DBMS may load the data from persistent or non-persistent storage and perform computations to respond to the query. The DBMS may return the result(s) to the user or software application.

The computing system of FIG. 12.1 may include functionality to present raw and/or processed data, such as results of comparisons and other processing. For example, presenting data may be accomplished through various presenting methods. Specifically, data may be presented through a user interface provided by a computing device. The user interface may include a GUI that displays information on a display device, such as a computer monitor or a touchscreen on a handheld computer device. The GUI may include various GUI widgets that organize what data is shown as well as how data is presented to a user. Furthermore, the GUI may present data directly to the user, e.g., data presented as actual data values through text, or rendered by the computing device into a visual representation of the data, such as through visualizing a data model.

For example, a GUI may first obtain a notification from a software application requesting that a particular data object be presented within the GUI. Next, the GUI may determine a data object type associated with the particular data object, e.g., by obtaining data from a data attribute within the data object that identifies the data object type. Then, the GUI may determine any rules designated for displaying that data object type, e.g., rules specified by a software framework for a data object class or according to any local parameters defined by the GUI for presenting that data object type. Finally, the GUI may obtain data values from the particular data object and render a visual representation of the data values within a display device according to the designated rules for that data object type.

Data may also be presented through various audio methods. In particular, data may be rendered into an audio format and presented as sound through one or more speakers operably connected to a computing device.

Data may also be presented to a user through haptic methods. For example, haptic methods may include vibrations or other physical signals generated by the computing system. For example, data may be presented to a user using a vibration generated by a handheld computer device with a predefined duration and intensity of the vibration to communicate the data.

The above description of functions present only a few examples of functions performed by the computing system of FIG. 12.1 and the nodes and/or client device in FIG. 12.2. Other functions may be performed using one or more embodiments.

While tracer tracking has been described with respect to a limited number of embodiments, those skilled in the art, having benefit of this disclosure, will appreciate that other embodiments can be devised which do not depart from the scope disclosed herein. Accordingly, the scope should be limited only by the attached claims.

What is claimed is:

1. A method for tracer tracking for control of flow control devices on injection wells, the method comprising:

executing, by at least one computer processor, a reservoir model using a plurality of numerical tracers to obtain a plurality of output values for at least one producer well, wherein each of the plurality of numerical tracers comprises a numerical or alphanumeric identifier (ID), wherein:

each of the plurality of numerical tracers is assigned to at least one corresponding injection flow control device comprised in a plurality of injection flow control devices of at least one injection well of the injection wells, wherein the plurality of numerical tracers comprises first and second numerical tracers assigned to respective first and second injection flow control devices of the plurality of injection flow control devices of a first injection well of the injection wells, wherein the first and second injection flow control devices are independently controllable based on the respective first and second numerical tracers to inject fluid into respective first and second geological layers; and the at least one corresponding injection flow control device comprises a flow control valve;

calculating, from the plurality of output values at the at least one producer well, a set of volume fractions for the plurality of injection flow control devices;

solving, by the at least one computer processor using the set of volume fractions, an optimization problem to obtain a flow control device parameter;

storing the flow control device parameter in storage;

generating on a display device, using the flow control device parameter, an aperture setting for the at least one corresponding injection flow control device; and initiating, using the aperture setting, adjusting of an aperture associated with the at least one corresponding injection flow control device.

2. The method of claim 1, further comprising:

calculating, by the at least one computer processor, a flow control device function using the flow control device parameter to obtain an aperture setting for at least one flow control device of the plurality of injection flow control devices.

3. The method of claim 2, further comprising:

detecting, using at least one sensor, a current production rate of the at least one producer well; and using the current production rate as input to the flow control device function when calculating the flow control device function.

4. The method of claim 1, further comprising:

executing, using the at least one computer processor, the reservoir model for a plurality of realizations, each realization corresponding to a set of aperture settings for the plurality of injection flow control devices to obtain the plurality of output values for each of the plurality of realizations;

calculating the set of volume fractions for each of the plurality of realizations; and using the set of volume fractions for each of the plurality of realizations when solving the optimization problem.

5. The method of claim 1, wherein the plurality of numerical tracers comprises a single numerical tracer assigned to at least two injection flow control devices of the plurality of injection flow control devices.

6. The method of claim 5, wherein the at least two injection flow control devices are located in a same subsurface zone of a field associated with the at least one injection well.

7. The method of claim 1, further comprising:

defining an individual flow control device parameter for each of a plurality of subsets of the plurality of injection flow control devices.

8. The method of claim 1, wherein the flow control device parameter defines a curvature of a flow control device function, the flow control device function using, as input, a production value at the at least one producer well to generate, as output, an aperture setting, the aperture setting defining a percentage of opening of an injection flow control device.

9. The method of claim 1, wherein the optimization problem comprises an objective function to maximize oil production.

10. The method of claim 1, wherein the optimization problem comprises an objective function to maximize net present value.

11. A system for tracer tracking for control of flow control devices on injection wells, the system comprising:

at least one computer processor;

a data repository comprising a reservoir model;

a reservoir modeling tool configured to execute on the at least one computer processor, and configured to execute the reservoir model using a plurality of numerical tracers to obtain a plurality of output values for at least one producer well, wherein each of the plurality of numerical tracers comprises a numerical or alphanumeric identifier (ID), wherein:

each of the plurality of numerical tracers is assigned to at least one corresponding injection flow control device comprised in a plurality of injection flow control devices of at least one injection well of the injection wells, wherein the plurality of numerical tracers comprises first and second numerical tracers assigned to respective first and second injection flow control devices of the plurality of injection flow control devices of a first injection well of the injection wells, wherein the first and second injection flow control devices are independently controllable based on the respective first and second numerical tracers to inject fluid into respective first and second geological layers; and the at least one corresponding injection flow control device comprises a flow control valve;

a volume fraction calculator configured to execute on the at least one computer processor, and configured to calculate, from the plurality of output values at the at least one producer well, a set of volume fractions for the plurality of injection flow control devices; and an optimization problem solver configured to execute on the at least one computer processor, and configured to:

solve, the set of volume fractions, an optimization problem to obtain a flow control device parameter;

store the flow control device parameter in storage;

generate on a display device, using the flow control device parameter, an aperture setting for the at least one corresponding injection flow control device; and initiate, using the aperture setting, adjusting of an aperture associated with the at least one corresponding injection flow control device.

12. The system of claim 11, further comprising:

an oilfield controller configured to execute on the at least one computer processor, and configured to calculate a flow control device function using the flow control device parameter to obtain an aperture setting for at least one flow control device of the plurality of injection flow control devices.

13. The system of claim 12, wherein the oilfield controller is further configured to execute on the at least one computer processor, and further configured to:

detect, using at least one sensor, a current production rate of the at least one producer well, and use the current production rate as input to the flow control device function when calculating the flow control device function.

14. The system of claim 11, wherein the plurality of numerical tracers comprises a single numerical tracer assigned to at least two injection flow control devices of the plurality of injection flow control devices.

15. The system of claim 14, wherein the at least two injection flow control devices are located in a same subsurface zone of a field associated with the at least one injection well.

16. The system of claim 11, wherein the flow control device parameter defines a curvature of a flow control device function, the flow control device function using, as input, a production value at the at least one producer well to generate, as output, an aperture setting, the aperture setting defining a percentage of opening of an injection flow control device.

17. A non-transitory computer readable medium for tracer tracking for control of flow control devices on injection wells, the non-transitory computer readable medium comprising instructions for:

executing, by at least one computer processor, a reservoir model using a plurality of numerical tracers to obtain a plurality of output values for at least one producer well, wherein each of the plurality of numerical tracers comprises a numerical or alphanumeric identifier (ID), wherein:

each of the plurality of numerical tracers is assigned to at least one corresponding injection flow control device in a plurality of injection flow control devices of at least one injection well of the injection wells, wherein the plurality of numerical tracers comprises first and second numerical tracers assigned to respective first and second injection flow control devices of the plurality of injection flow control devices of a first injection well of the injection wells, wherein the first and second injection flow control devices are independently controllable based on the respective first and second numerical tracers to inject fluid into respective first and second geological layers; and the at least one corresponding injection flow control device comprises a flow control valve;

calculating, from the plurality of output values at the at least one producer well, a set of volume fractions for the plurality of injection flow control devices;

solving, by the at least one computer processor using the set of volume fractions, an optimization problem to obtain a flow control device parameter;

storing the flow control device parameter in storage;

generate on a display device, using the flow control device parameter, an aperture setting for the at least one corresponding injection flow control device; and initiate, using the aperture setting, adjusting of an aperture associated with the at least one corresponding injection flow control device.

18. The non-transitory computer readable medium of claim 17, further comprising instructions for:

calculating, by the at least one computer processor, a flow control device function using the flow control device parameter to obtain an aperture setting for at least one flow control device of the plurality of injection flow control devices.

19. The non-transitory computer readable medium of claim 18, further comprising instructions for:

detecting, using at least one sensor, a current production rate of the at least one producer well; and using the current production rate as input to the flow control device function when calculating the flow control device function.

20. The non-transitory computer readable medium of claim 17, further comprising instructions for:

executing, using the at least one computer processor, the reservoir model for a plurality of realizations, each realization corresponding to a set of aperture settings for the plurality of injection flow control devices to obtain the plurality of output values for each of the plurality of realizations;

calculating the set of volume fractions for each of the plurality of realizations; and using the set of volume fractions for each of the plurality of realizations when solving the optimization problem.

* * * * *